US008541954B2

(12) United States Patent
Saka et al.

(10) Patent No.: US 8,541,954 B2
(45) Date of Patent: Sep. 24, 2013

(54) LIGHT SOURCE APPARATUS

(75) Inventors: Kosuke Saka, Hyogo (JP); Kazuhiro Goto, Hyogo (JP); Takashi Yamashita, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 223 days.

(21) Appl. No.: 13/064,194

(22) Filed: Mar. 10, 2011

(65) Prior Publication Data

US 2011/0221356 A1 Sep. 15, 2011

(30) Foreign Application Priority Data

Mar. 10, 2010 (JP) ..... 2010-052978

(51) Int. Cl.
*H05B 41/16* (2006.01)
*H05B 41/36* (2006.01)

(52) U.S. Cl.
USPC ..... 315/246; 315/307

(58) Field of Classification Search
USPC ..... 315/246, 307, 291, 224, 194, 209 R, 315/DIG. 7; 353/85
See application file for complete search history.

(56) References Cited

U.S. PATENT DOCUMENTS

| | | | | |
|---|---|---|---|---|
| 7,944,150 | B2 * | 5/2011 | Hirao | 315/224 |
| 7,960,923 | B2 * | 6/2011 | Arimoto et al. | 315/307 |
| 2002/0011803 | A1 | 1/2002 | Derra et al. | |
| 2006/0125415 | A1 | 6/2006 | Geijtenbeek et al. | |
| 2007/0132403 | A1 | 6/2007 | Goto et al. | |
| 2008/0315782 | A1 * | 12/2008 | Hirao | 315/224 |
| 2010/0148686 | A1 * | 6/2010 | Arimoto et al. | 315/246 |

FOREIGN PATENT DOCUMENTS

| | | | |
|---|---|---|---|
| JP | 2002-15883 | A | 1/2002 |
| JP | 2003-347071 | A | 12/2003 |
| JP | 2005-526362 | A | 9/2005 |
| JP | 2007-087637 | A | 4/2007 |
| JP | 2007-165067 | A | 6/2007 |
| JP | 2009-004152 | A | 1/2009 |
| WO | WO03/098659 | A2 | 11/2003 |

OTHER PUBLICATIONS

Japanese Office Action issued Feb. 23, 2012 for corresponding Japanese Application No. 2010-052978.

* cited by examiner

*Primary Examiner* — Daniel D Chang
(74) *Attorney, Agent, or Firm* — Rader, Fishman & Grauer PLLC

(57) ABSTRACT

A first energy ratio A/B of a first alternating current of a steady frequency supplied to a lamp is set to a value C, when the lamp is horizontally placed. A second alternating current of a lower frequency, whose second energy ratio A/B is set to the value C, is inserted. When the lamp is vertically placed, a first energy ratio A'/B' is set to the value C or a value D, which is smaller than the value C. A second ratio A'/B' is set to the value D or a value E, which is lower than the value C. A and A' each represents an energy that flows from a first electrode of a pair of electrodes of the lamp to a second electrode of the pair. B and B' each represents an energy that flows from the second electrode to the first electrode.

11 Claims, 13 Drawing Sheets

Horizontal arrangement

Vertical arrangement

Duty ratio 40:60

Low frequency insertion frequency: 1.1

Horizontal arrangement

Vertical arrangement

Horizontal arrangement

Vertical arrangement

Duty ratio 40:60
Low frequency insertion frequency: 2.0

Horizontal arrangement

Vertical arrangement

Horizontal arrangement

Vertical arrangement
Electric power ratio
40 : 60
Low frequency insertion ratio: 4.0

Horizontal arrangement

Vertical arrangement

Horizontal arrangement

Vertical arrangement

FIG.11A

Experimental result (1)

| Duty (+:-) | Low frequency insertion frqncy (relative value to prior art) | | | | | | | | |
|---|---|---|---|---|---|---|---|---|---|
| | 0.3 | 0.35 | 0.4 | 0.45 | 0.5 | 0.55 | ・・・ | 1 | 1.15 |
| 20 : 80 | F | F | F | F | F | F | | F | F |
| 25 : 75 | A | B | B | B | B | O | | O | O |
| 30 : 70 | A | B | B | O | O | O | | O | O |
| 35 : 65 | A | B | O | O | O | O | ・・・ | O | O |
| 40 : 60 | A | C | O | O | O | O | | O | O |
| 45 : 55 | C | C | C | O | O | O | | O | O |
| 50 : 50 | C | C | C | C | C | C | | E | E |

A Upper/Lower: Low
B Upper: Low
C Lower: Low
D Upper/Lower:High
E Upper: High
F Lower: High

| Duty (+:-) | Low frequency insertion frequency (relative value to prior art) | | | | | | | | | | | |
|---|---|---|---|---|---|---|---|---|---|---|---|---|
| | 1.2 | 1.25 | 1.3 | 1.4 | 1.45 | 1.5 | 1.6 | 1.65 | 1.7 | 1.8 | 1.9 | 2 |
| 20 : 80 | F | F | F | F | F | F | F | F | F | F | F | F |
| 25 : 75 | O | O | O | O | F | F | F | F | F | F | F | F |
| 30 : 70 | O | O | O | O | O | O | F | F | F | D | D | D |
| 35 : 65 | O | O | O | O | O | E | E | D | D | D | D | D |
| 40 : 60 | O | O | E | E | E | E | E | E | D | D | D | D |
| 45 : 55 | E | E | E | E | E | E | E | E | E | E | E | D |
| 50 : 50 | E | E | E | E | E | E | E | E | E | E | E | E |

FIG.11B

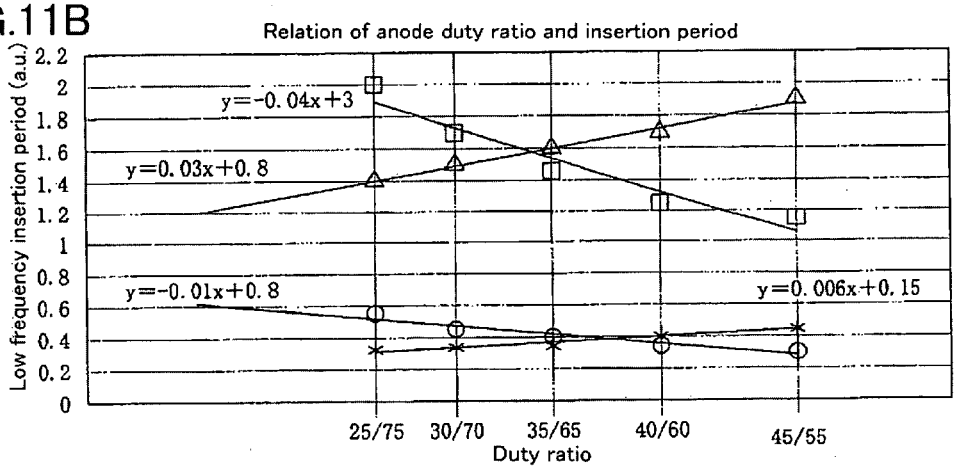

FIG.11C

| 25/75 | 30/70 | 35/65 | 40/60 | 45/55 |
|---|---|---|---|---|
| 0.33 | 0.43 | 0.54 | 0.67 | 0.82 |
| 2 | 1.7 | 1.45 | 1.25 | 1.15 |
| 1.4 | 1.5 | 1.6 | 1.7 | 1.9 |
| 0.55 | 0.45 | 0.4 | 0.35 | 0.3 |
| 0.32 | 0.35 | 0.35 | 0.4 | 0.45 |

Experimental result (2)

| Duty (+:-) | Low frequency insertion frqncy (relative value to prior art) | | | | | | | | | | | | |
|---|---|---|---|---|---|---|---|---|---|---|---|---|---|
| | 1 | 2 | 2.5 | 3 | 3.5 | 4 | ・・・ | 8 | 9 | 10 | 11 | 12 | 13 |
| 20 : 80 | F | F | F | F | F | F | | F | F | F | F | F | F |
| 25 : 75 | E | O | O | O | O | O | | O | F | F | F | F | F |
| 30 : 70 | E | E | O | O | O | O | | O | O | F | F | F | F |
| 35 : 65 | E | E | E | O | O | O | ・・・ | O | O | O | F | F | F |
| 40 : 60 | E | E | E | E | O | O | | O | O | O | O | F | F |
| 45 : 55 | E | E | E | E | E | O | | O | O | O | O | O | F |
| 50 : 50 | E | E | E | E | E | E | | E | E | E | E | E | E |

E Upper: High

F Upper: High

Relation of anode duty ratio and insertion period

| 25/75 | 30/70 | 35/65 | 40/60 | 45/55 |
|---|---|---|---|---|
| 0.33 | 0.43 | 0.54 | 0.67 | 0.82 |
| 2 | 2.5 | 3 | 3.5 | 4 |
| 8 | 9 | 10 | 11 | 12 |

Horizontal arrangement

Vertical arrangement

LIGHT SOURCE APPARATUS

CROSS-REFERENCES TO RELATED APPLICATION

This application claims priority from Japanese Patent Application Serial No. 2010-052978 filed Mar. 10, 2010, the contents of which are incorporated herein by reference in their entirety.

TECHNICAL FIELD

The present invention relates to a light source apparatus or, more specifically, to a light source apparatus capable of lighting a lamp even whether the lamp is arranged horizontally or vertically.

BACKGROUND

A light source apparatus used for a projector apparatus is described in Japanese Patent Application Publication Nos. 2007-087637, 2003-347071, 2002-015883 and 2007-165067. Japanese Patent Application Publication No. 2007-087637 discloses a light source apparatus having a lamp lighted with alternating current, which is used for a projector apparatus, wherein it is possible to prevent formation of an unnecessary projection(s) by periodically inserting a low frequency into a steady frequency (refer to paragraph [0021] of the patent application publication). Japanese Patent Application Publication No. 2003-347071 discloses a light source apparatus, used for a projector apparatus having a lamp, which is lighted with alternating current. Japanese Patent Application Publication No. 2003-347071 discloses that a lamp is vertically arranged and lighted, wherein when the vertically arranged lamp is lighted, time T1, during which voltage is applied to an upper electrode serving as a negative electrode, is longer than time T2, during which voltage is applied to a lower electrode serving as a negative electrode, whereby it is possible to suppress a rise in temperature of the upper electrode (for example, refer to paragraph [0029] of the patent application publication).

Japanese Patent Application Publication No. 2002-015883 discloses a gas discharge lamp for a video projector, which is lighted with alternating current, wherein two or more operation frequencies, for example, 45, 65, 90, and130 Hz, are used to form a projection at an electrode tip. Moreover, when alternating current is inputted, a current value is changed in pulse form (refer to FIG. 1 of Japanese Patent Application Publication No. 2007-165067). Japanese Patent Application Publication No. 2007-165067 discloses a light source apparatus having a lamp lighted with alternating current, which is used for a projector apparatus, wherein a color wheel is used for the projector apparatus (for example, refer to paragraph [0013] of the patent application publication).

A projector apparatus may be used for advertising media with an image called digital signage, wherein such media are required to be displayed in various directions or at various places because of the nature of advertisement. Usually, such a light source apparatus for digital signage is not set in a fixed projecting direction or a fixed projection place, that is, a lamp is sometimes required to be horizontally placed to light the lamp, or sometimes vertically placed to light the lamp. Thus, such a light source apparatus for digital signage is expected so that the lamp, which is provided in the light source apparatus, can be lighted even if it is placed either horizontally or vertically. A light source apparatus disclosed in Japanese Patent Application Publication No. 2007-087637 is designed so that the lamp is horizontally arranged. When such a lamp is horizontally arranged, a duty ratio of current supplied to the lamp is generally approximately 1:1. In such a light source apparatus disclosed in Japanese Patent Application Publication No. 2007-087637, if the lamp is lighted when the lamp is vertically arranged, a heat convection arises inside the lamp so that the temperature of the upper electrode becomes higher than that of the lower electrode. In such a kind of lamp, since the electrode is overheated, and in addition to the overheating, heating due to the heat convention is added, there is a problem that the upper electrode melts and is damaged. Moreover, even if the lower electrode cools down more than the upper electrode, so that even if low frequency is inserted, formation of an unnecessary projection cannot be suppressed.

The light source apparatus, which is disclosed in Japanese Patent Application Publication No. 2003-347071, is designed so that a lamp is vertically arranged, and a duty ratio of current supplied to the lamp is different. Thus, when the lamp is horizontally arranged in such a light source apparatus, there is a problem that one of electrodes is overheated, more than the other electrode, so that the one of the electrodes may be damaged. As in the apparatus disclosed in Japanese Patent Application Publication No. 2007-087637, in a light source apparatus disclosed in Japanese Patent Application Publication No. 2002-015883, a lamp used in a vertical arrangement is not assumed. Moreover, in some of such light source apparatuses used for a projector apparatus, as shown in Japanese Patent Application Publication No. 2007-165067, light is emitted through a color wheel, which is divided into R, G, B, and W areas. However, when such a color wheel is used, if the polarity of current to be supplied to the lamp changes in a portion between two adjacent areas of the R, G, B, and W, a ripple arises, so that the illumination of light from the lamp becomes temporarily high and low (bright and dark). Therefore, as shown in FIG. 13A, it is desirable to match area change timing of the R, G, B, and W areas of such a color wheel with polarity change timing. In the light source apparatus disclosed in Japanese Patent Application Publication No. 2003-347071, the lamp is designed to be arranged vertically, and a duty ratio of current supplied to a lamp (ratio of a period, in which the polarity of the current is positive, to a negative period thereof) is not set to 1:1, so that, as shown in FIG. 13B, when it is applied to an apparatus, in which a color wheel is used, the current polarity change timing and area change timing of the R, G, B, and W areas of the color wheel are not necessarily in agreement with each other. Therefore, due to a ripple, which occurs when the current polarity changes, the illumination of light from the lamp becomes temporarily high and low (bright and dark). Thus, flickering occurs.

Moreover, although the entire liquid crystal screen on a display is refreshed at a fixed rate (refresh rate) on the display, if this refresh rate (vertical frequency) and the polarity change timing of the current impressed to the electrode of the lamp are not synchronized flickering occurs, as in the case of the above-mentioned color wheel. In the case of Japanese Patent Application Publication No. 2003-347071, as shown in FIG. 13B, since the duty ratio of current does not necessarily turn into 1:1, timing of refreshing the entire liquid crystal screen and current polarity change timing are not in agreement. Thus, similarly to the color wheel case, the illumination of light from the lamp becomes temporarily high and low (bright and dark) and flickering occurs.

As mentioned above, the light source apparatus of the prior art is not configured so that the lamp can be lighted in either a horizontal arrangement or a vertical arrangement, and when a light source apparatus designed so that the lamp thereof is lighted in a horizontal arrangement, is installed and lighted in a vertical arrangement, there is a problem, on which an upper electrode melted and damaged. Moreover, as disclosed in Japanese Patent Application Publication No. 2003-347071, it is proposed that such a lamp can be used in vertical arrangement, by setting a period, in which the polarity of current supplied to the lamp is positive, so as to be different from a negative current period. However, when a color wheel or a liquid crystal display is used, current polarity change timing is not necessarily in agreement with the change timing of the R, G, B and W areas of the color wheel, or the refreshment timing of a liquid crystal display, so that there is a problem on which a flicker occurs on the screen.

SUMMARY

To solve the above-mentioned problems, the below a light source apparatus is capable of lighting a lamp without causing a problem such as a damage to an electrode even if the lamp is horizontally or vertically arranged, suppressing formation of unnecessary projection, and of displaying an image on a screen without causing a flicker even if the present invention is applied to an apparatus using a color wheel.

That is, a light source apparatus comprising a high pressure discharge lamp enclosing in a discharge container mercury and a pair of electrodes arranged to face each other. A power supply apparatus supplies a first alternating current at a first predetermined frequency to the discharge lamp. The power supply apparatus inserts a second alternating current at a second predetermined frequency which is lower than the first predetermined frequency and supplies the second alternating current to the high pressure discharge lamp. When the discharge lamp is placed horizontally, a first electric energy ratio A/B of the first alternating current is set to a first value C. A second electric energy ratio A/B of the second alternating current is set to the first value C. When the discharge lamp is placed vertically, a first electric energy ratio A'/B' of the first alternating current is set to the first value C or a second value D, which is smaller than the first value C. A second electric energy ratio A'/B' of the second alternating current is set to the second value D or a third value E, which is smaller than the first value C. The values A and A' above each represents an electric energy that flows from a first electrode of the pair of electrodes to a second electrode of the pair of electrodes. The values B and B' above each represents an electric energy that flows from the second electrode to the first electrode.

The power supply apparatus may insert the second alternating current into the first alternating current according to a predetermined insertion frequency y. When the lamp is placed vertically, the first electric energy ratio A'/B' may be set to the second value D, and the second electric energy ratio A'/B' may be set to the third value E. The second value D may be set to fall within a range of $1/3 \leqq D < 1$. The insertion frequency y×100% may be set to fall within a range of formula:

$$-0.01E+0.8 \leqq y \leqq 0.03E+0.8 \quad (1)$$

$$0.006E+0.15 \leqq y \leqq -0.04E+3 \quad (2).$$

Furthermore, the third value E may be equal to the second value D.

Alternatively, the first electric energy ratio A'/B' may be set to the first value C, and the second electric energy ratio A'/B' may be set to the third value E. In this case, the third value E may be set to fall within a range of $1/3 \leqq E < 1$, and the insertion frequency z×100% may be set to fall within a formula:

$$4E+0.7 \leqq z \leqq 8E+5 \quad (3).$$

BRIEF DESCRIPTION OF THE DRAWINGS

Other features and advantages of the present light source apparatus will be apparent from the ensuing description, taken in conjunction with the accompanying drawings, in which:

FIGS. 11A, 11B, and 11C are diagrams showing an experimental result (1);

DESCRIPTION

Figure 1:
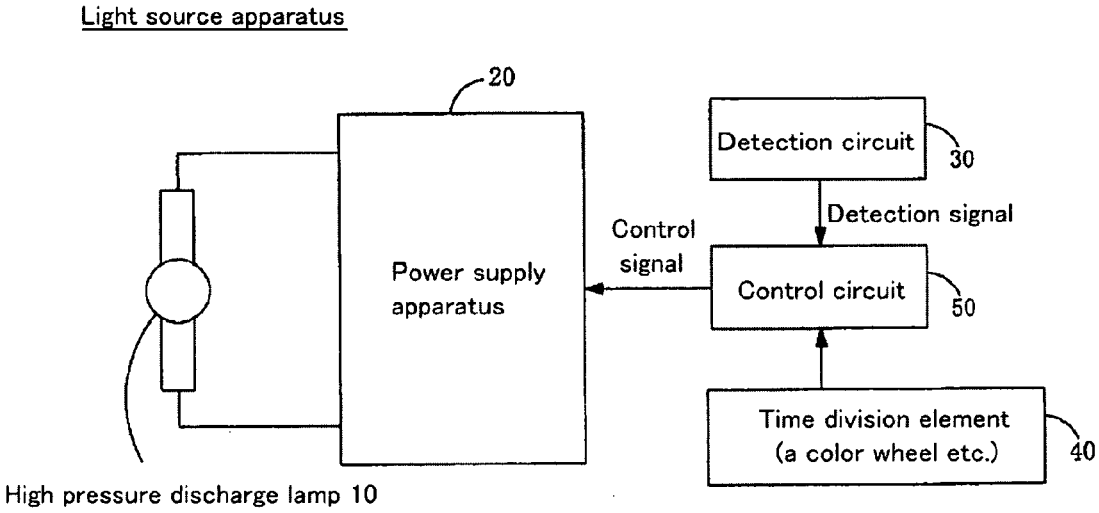
FIG. 1 is a block diagram of a light source apparatus.

In a light source apparatus according to the present invention, including a high pressure discharge lamp, in which mercury is enclosed while a pair of electrodes is arranged to face each other inside a discharge container, and a power supply apparatus, which supplies alternating current to the lamp, in order that a lamp is lighted in either horizontal arrangement or vertical arrangement, without producing the problem of a partial loss of an electrode(s), while low frequency is periodically inserted during steady frequency lighting, if electric energy that flows from a first or one electrode of the lamp to a second or other electrode is represented as "A", and electric energy that flows from the other electrode is represented as "B", a ratio A/B of the above-mentioned electric energy is set up as set forth below. That is, in the case of horizontal arrangement, when the lamp is lighted at the steady lighting frequency (hereinafter referred to as steady frequency) and also when the lamp is lighted at low frequency, the ratio A/B of the above-mentioned electric energy is set to a first value C ($A \leqq B$), and in the case of vertical arrangement, it is set as set forth below as method A or method B.

In case where the lamp is lighted at the steady lighting frequency and at the low frequency, a ratio A'/B' (electric energy flowing from the first or one electrode (upper electrode) to the second or other electrode (lower electrode) is represented as A', and electric energy flowing from the other electrode (lower electrode) to the one electrode (upper electrode) is set to B'), is set to a value Different from that in case of the horizontal arrangement. Namely, the alternating current is supplied thereto at the above-mentioned steady frequency, in which the ratio A'/B' of electric energy is set to a second value D, which is smaller than the first value C, and at a predetermined repetition degree (frequency), alternating current of predetermined low frequency, which is lower than the above-mentioned steady frequency, is inserted and the ratio A'/B' of the above-mentioned electric energy of the alternating current of this low frequency is set to a third value E, which is smaller than the above-mentioned first value C, thereby lighting the above-mentioned lamp.

At time of lighting at the steady lighting frequency (the above-mentioned electric power ratio is approximately 1 at the above-mentioned "C"), the ratio A'/B' of electric energy is set to be equal to that in the case of horizontal arrangement, and only at time of the low frequency lighting, the electric power ratio is set to be different from that in the case of horizontal arrangement. That is, alternating current of the above-mentioned steady frequency is supplied, wherein the electric energy ratio A'/B' is set to the above-mentioned first value C, and the alternating current of the low frequency, which is lower than the above-mentioned steady frequency, is inserted at a predetermined repetition degree (frequency), wherein the above-mentioned electric energy ratio A'/B' of the low frequency alternating current is set to the third value E, which is smaller than the above-mentioned first value C, thereby lighting the lamp. In addition, although the above value C is usually set to approximately 1, even if the lamp is horizontally arranged because of the circumferential environment of the lamp, for example, in case where the reflective mirror is provided in a circumference of a lamp, one of a pair of electrodes in the lamp may sometimes become hotter than the other electrode. In such case, the above value C does not necessarily turn into 1.

The following effects can be acquired in a present invention. As described above, when a signal indicating a horizontal arrangement state of the lamp is inputted, a ratio A/B of the electric energy is set to a first value C, where electric energy flowing from one electrode to the other electrode is represented as a and electric energy flowing from the other electrode to the one electrode is set as b, and the alternating current at the above-mentioned steady frequency is supplied. Further, alternating current of predetermined lower frequency lower than the steady frequency, in which the ratio of the electric energy is the first value C, is inserted at a predetermined degree (frequency) to light the lamp. Moreover, when a signal indicating a vertical arrangement state of the lamp is inputted, a ratio A'/B' of the electric energy is set to the first value C or to a second value D, which is smaller than the first value C, where electric energy that flows from a one or upper side electrode to a second or lower side electrode is represented as A' and electric energy that flows from the lower side electrode to the upper side electrode is represented as B', and the alternating current of the steady frequency is supplied, and the alternating current of predetermined low frequency lower than the above-mentioned steady frequency is inserted at a predetermined repetition degree (frequency), wherein the ratio A'/B' of the above-mentioned electric energy of the low frequency alternating current is set to a third value E smaller than the first value C, thereby lighting the lamp. Thus, since the lamp is lighted in such a way, it is possible to light the lamp, in either horizontal arrangement or vertical arrangement, without producing the problem of the loss or damage of an electrode, and to suppress formation of an unnecessary projection(s).

Even in an apparatus in which a color wheel or a liquid crystal display is used, it is possible to mach polarity change timing with area change timing of the color wheel or with refresh rate of the liquid crystal display, so that it is possible to display an image (s) on the display without causing flickers of the display.

FIG. 1 shows a schematic structure of a light source apparatus. As shown in FIG. 1, the light source apparatus comprises a high pressure discharge lamp 10, a power supply apparatus 20 that is electrically connected to a pair of electrodes provided in the lamp 10, a control circuit 50 that outputs a control signal to the power supply apparatus 20, a detection circuit 30 that outputs a signal indicating a state of the lamp 10 (horizontal arrangement or vertical arrangement) to the control circuit 50, a time division element 40 that outputs a time division signal for switching timing of an area of a color wheel or for a refresh rate of a liquid crystal to the control circuit 50. For example, a pendulum element can be used for the detection circuit 30 that detects the arrangement direction of the lamp 10. That is, the pendulum element, in which inclination thereof changes according to the arrangement state of the lamp (horizontal or vertical arrangement), is provided, so that the inclination of the pendulum element is detected, so as to detect the arrangement state of the lamp (horizontal or vertical arrangement).

Moreover, a piezo-electric element that generates an output according to the lamp installation state or a switch that opens and closes according to the lamp installation state may be provided on a wall face or a bottom face of the light source apparatus. Thus, when the light source apparatus is installed so that the lamp may be horizontally arranged, a first piezoelectricity element generates an output or the switch is turned on. When the light source apparatus is installed so that the lamp may be vertically arranged, the arrangement direction of the lamp may be detected by configuring a second piezoelectricity element to generate an output or so that a switch may be turned on. In the present invention, it is not indispensable to provide the above-mentioned detection circuit. If a changeover switch. is provided, a user may change the switch according to the arrangement state of the lamp. For example, a user may check the arrangement state by viewing the lamp, and input the state (information) into the light source apparatus with a remote controller. In such case, a receiving circuit, which receives a signal from the remote controller, is provided in the control circuit 50, in place of the detection circuit.

Figure 2:
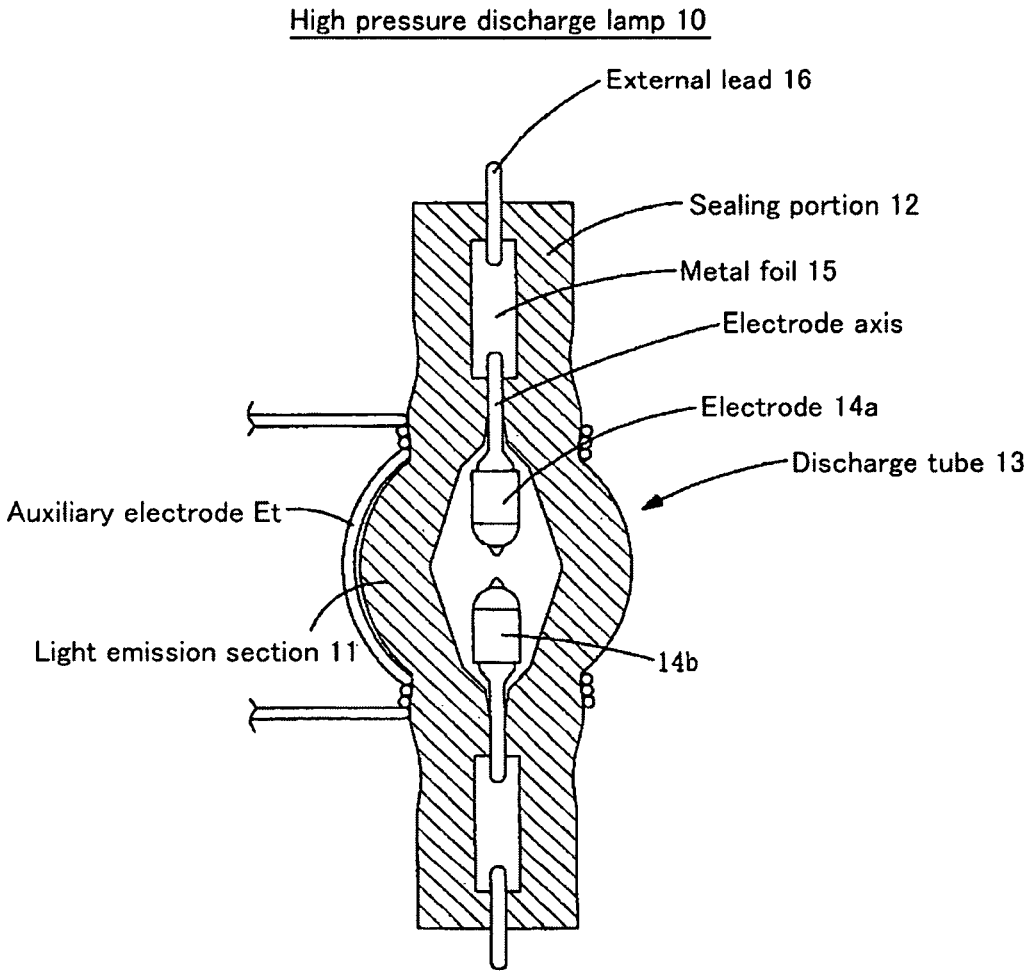
FIG. 2 is a cross sectional view of a lamp provided in a light source apparatus.

FIG. 2 is a cross sectional view of a lamp provided in a light source apparatus, and shows the structure of the above-mentioned high pressure discharge lamp 10 in detail. The high pressure discharge lamp 10 comprises a discharge tube 13, which is made up of a spherical light emission section 11 and a cylindrical sealing portions 12, a pair of electrodes 14*a* and 14*b* arranged to face each other inside the light emission section 11, metallic foils 15 that are electrically connected to the respective electrodes 14*a* and 14*b* and buried in the respective sealing portions 12, and external leads 16 projecting from the respective sealing portions 12 and electrically connected to the respective metallic foils 15. Moreover, an auxiliary electrode Et, to which high voltage is impressed at start-up time of lighting of the lamp, is provided on an outer circumference portion of the light emission section 11. Mercury, rare gas, and halogen gas are enclosed in the light emission section 11. The mercury is enclosed to obtain a wavelength of a required visible light, for example, a radiation light, whose wavelength is 360 nm-780 nm. The amount of the mercury enclosed is 0.15 mg/mm$^3$ or more. Although the enclosed amount also varies depending on temperature conditions, it is possible to realize a discharge lamp, whose mercury vapor pressure is as high as 200 atmospheres to 300 atmospheres or more at time of lighting, Thus, it is possible to realize a light source, in which luminance is further improved, as the mercury vapor pressure becomes higher. For example, approximately 13 kPa of argon gas is enclosed as the rage gas, which improves the lighting nature. Iodine, bromine, chlorine, etc. are enclosed as a halogen in form of a compound with mercury or other metal. The enclosed amount of halogen is selected from a range of 1×10−6 μmol/mm$^3$ to 1×10−2 μmol/mm$^3$. Although a function of the halogen is to extend a life span by using the so-called halogen cycle, the halogen also functions to prevent devitrification of an electric discharge container, in the case where the discharge lamp is very small and the lighting vapor pressure is very high, as in the currently described high pressure discharge lamp. If the numerical example of the discharge lamp is shown, for example, the maximum outer diameter of the light emission section is 9.5 mm, the distance between the electrodes is 1.5 mm, and the internal volume of the arc tube is 75 mm$^3$. Rated voltage applied is 70 V, rated power applied is 200 W, and alternating current lighting is performed.

Figure 3:
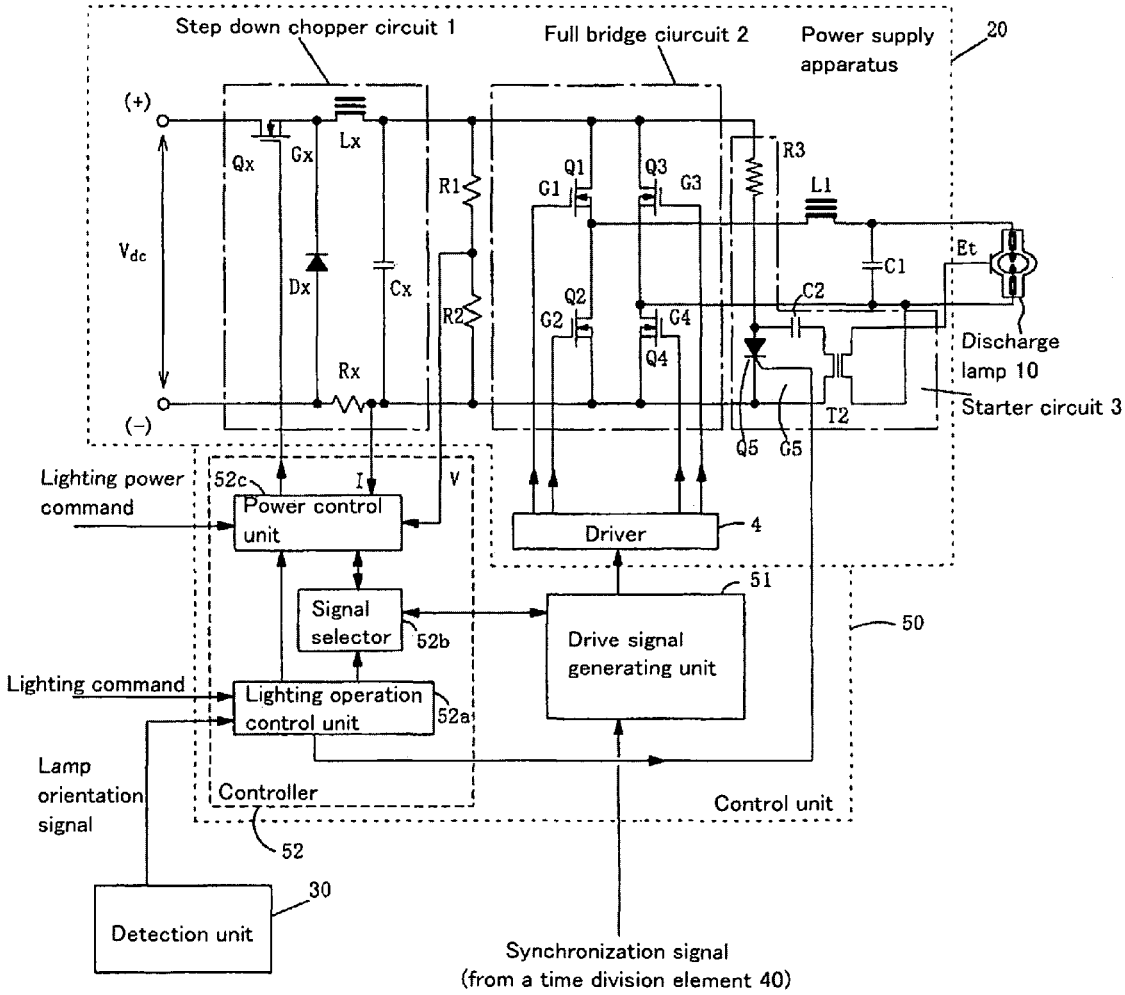
FIG. 3 is a diagram showing a circuit configuration.

FIG. 3 shows an example of a specific circuit structure of the light source apparatus shown in FIG. 1. A power supply apparatus 20 comprises a step down chopper circuit 1 to which direct-current voltage is supplied, a full bridge type inverter circuit 2 (hereinafter referred to as a "full bridged circuit") that is connected to an output side of the step down chopper circuit 1 and that converts direct current voltage to alternating current voltage to supply the alternating current voltage to the discharge lamp 10, a coil L1, which is in series connected to the discharge lamp 10, a capacitor C1, a starter circuit 3, and a driver 4, which drives switching elements Q1-Q4 of the full bridged circuit 2. The control unit 50 may be configured by a processing unit, such as a microprocessor. In FIG. 3, a function of the control unit 50 is shown as a block.

In FIG. 3, a step down chopper circuit 1 comprises a switching element Qx and a reactor Lx, which are connected to a plus terminal of a power supply to which the direct current voltage is supplied, a diode Dx whose cathode side is connected to a connecting point between the switching element Qx and the reactor Lx and whose anode side is connected to a minus terminal of the power supply, a smoothing capacitor Cx, which is connected to an output side of the reactor Lx, a resistor Rx for current detection, which is connected between the minus terminal of the smoothing capacitor Cx and the anode side of the diode Dx. By driving the switching element Qx at a predetermined duty ratio, input direct current voltage Vdc is stepped down to a certain voltage according to the duty ratio. A series circuit of resistors R1 and R2 for voltage detection is provided on an output side of the step down chopper circuit 1. The full bridge circuit 2 is made up of the switching elements Q1-Q4 connected to one another to form a bridge, in which a pair of the switching elements Q1 and Q4 and a pair of the switching elements Q2 and Q3 are turned on by turns, so that square wave alternating voltage occurs between a contacting point of the switching elements Q1 and Q2 and the switching elements Q3 and Q4.

A starter circuit 3 comprises a resistor R3, a series circuit of a switching element Q5, a capacitor C2, and a transformer T2. When the switching device Q5 is turned on, charges accumulated in the capacitor C2 are discharged through the switching device Q5 and a primary coil of the transformer T2, thereby generating high voltage pulse in the secondary coil of the transformer T1. This high voltage is applied to the auxiliary electrode Et of the discharge lamp 10, thereby turning on the lamp 10.

In the above-mentioned circuit, control of output electric power and adjustment of electric energy that flows into one electrode of the lamp to the other electrode, and electric energy that flows into the other electrode to the one electrode, can be attained by controlling the switching cycle of the switching elements Q1-Q4 of a full bridge circuit 2, or adjusting an operational duty of the switching device Qx of the step-down chopper circuit 1. The switching device Qx of the step-down chopper circuit 1 is turned on/off in response to the duty of the gate signal Gx, so that the power to be supplied to the lamp 10 is changed. In other words, the gate signal Gx is controlled to match an input power adjusting a signal value. For example, if the power is increased, the duty of the switching device Qx is increased, and if the power is decreased, the duty of the switching device Qx is decreased. Moreover, similarly, electric energy that flows from one electrode to the other electrode and electric energy that flows from the other electrode to the one electrode are also adjusted by changing the duty ratio, every polarity change of the lamp.

The control unit 50 is made up of a drive signal generating unit 51 and a controller 52. The drive signal generation unit 51, for example, is made up of a processor, and generates a drive signal for driving the switching elements Q1-Q4 of the full bridged circuit 2. The polarity change cycle of the discharge lamp 10 can be adjusted by controlling a drive signal outputted from the drive signal generation unit 51 in response to a synchronization signal (a synchronization signal from a color wheel, or a synchronization signal from a liquid crystal drive circuit) given from the time division element 40 shown in FIG. 1, and by adjusting the switching cycle of the switching elements Q1-Q4 of the full bridged circuit 2. The controller 52 includes a lighting operation control unit 52*a*, which controls a lighting operation of the lamp 10 in response to a lighting command or an output from the lamp arrangement direction detection circuit, and a drive signal selector 52*b*, which receives an output of the drive signal generation unit 51. Moreover, the controller 52 includes an electric power control unit 52*c*, wherein electric power for the lamp is controlled in response to a lighting electric power command from the outside, and wherein electric energy that flows from the one electrode to the other electrode and electric energy that flows from the other electrode to the one electrode is controlled in response to a signal indicating the arrangement direction of the lamp 10, which is given from the detection circuit 30 for detecting the arrangement orientation of the lamp.

The power control unit 52*c* obtains the lamp current I and the lamp voltage V from the resistor Rx, R1, and R2 and calculates the electric power. The duty ratio of the switching element Qx of the step down chopper circuit 1 is controlled so that this electric power corresponds to a predetermined power command value. The full bridged circuit 2 performs a polarity reversal operation in response to a drive signal from the driver 4. Moreover, the drive signal selector 52*b* receives a polarity change signal of the discharge lamp from the drive signal generation unit 51, and sends this polarity change signal to the electric power control unit 52*c*. Then, the electric power control unit 52*c* controls the electric energy that flows from the one electrode to the other electrode and the electric energy that flows from the other electrode to the one electrode in response to this polarity change signal.

Next, description of the control at time of lighting of the above mentioned light source apparatus will be given below. First, the outline of lighting control in each state of horizontal arrangement and vertical arrangement according to the present invention will be given below. In the present invention, the lighting methods are roughly divided into two, that is, (A) and (B) as shown in Table 1. Here, the power ratio is a ratio A/B. "B" represents the electric energy that flows from a first or one electrode (upper side electrode) to a second or other electrode (lower side electrode). a represents the electric energy that flows from the other electrode to the one electrode.

When the lamp is horizontally arranged, the lamp is turned on at the time of both steady frequency and low frequency and the power ratio is set to C (C=approximately 1/1). When vertically arranged, the power ratio of the steady frequency and the low frequency is set to be different from the power ratio at the time of horizontal arrangement. For example, in the case of the vertical arrangement, the above-mentioned power ratio is set to d at the time of steady frequency (for example, D=4/6), and the above-mentioned power ratio is set to e at the time of low frequency (for example, E=4/6, but "D" is not necessarily "E").

When the lamp is horizontally arranged, the lamp is turned on at both steady frequency and low frequency and power ratio is set to c (c=approximately 1/1). When vertically arranged and only at the time of low frequency, the power ratio is set to be different from the power ratio at the time of horizontal arrangement. For example, the power ratio is set to cat the time of steady frequency (for example, C=approximately 1/1) and the power ratio is set to d at the time of low frequency (for example, D=4/6, but the power ratio is not always the same as that of the above method (A)).

TABLE 1

| | | (A) | (B) |
|---|---|---|---|
| Horizontal arrangement | Electric power ratio at steady frequency | 1:1 (=C) | 1:1 (=C) |
| | Electric power ratio at low frequency | 1:1 (=C) | 1:1 (=C) |
| Vertical arrangement | Electric power ratio at steady frequency | 4:6 (=D) | 1:1 (=C) |
| | Electric power ratio at low frequency | 4:6 (=E) | 4:6 (=E) |

Generally, the lamp 10 is provided with a reflective mirror for reflecting light from the lamp. That is, the reflective mirror reflects light emitted from between the electrodes of the lamp which guides the reflected light in a light emitting direction. When the lamp is arranged so that a pair of electrodes of the lamp may become parallel to the light emitting direction of the reflective mirror, even if the lamp is horizontally arranged, the electrode, which is on the light emitting direction side (one of the pair of electrodes of the lamp, which is provided far from the mirror) receives the light reflected by the reflective mirror, thereby getting hotter than the electrode on the mirror side (one of the pair of electrodes, which is provided near the mirror). That is, even if the lamp is horizontally arranged, one of the electrodes may be heated more than the other electrode. In this case, it is desirable that electric energy flowing from the electrode located on the mirror side to the other electrode is different from electric energy flowing from the other electrode to the electrode located on the mirror side, so that the electrodes of the lamp are heated to approximately the same degree.

Since the amount of heat becomes larger as the electrode of the lamp receives more electrons, the electrodes that sends out more electric power is heated more than the other electrode, which receives the electric power. In this case, it is necessary to heat the electrodes of the lamp to approximately the same degree, so that electric energy, which flows to an electrode arranged on the mirror side from the other electrode, which is more heated (one of the electrodes, which is provided far from the mirror side) is made slightly smaller than the electric energy, which flows from the electrode arranged on the mirror side to the other electrode. Namely, Although the above-mentioned power ratio C is basically 1/1, if the ambient environment of the lamp is not considered, as mentioned above, even if the lamp is horizontally arranged, one electrode of a pair of electrodes of the lamp may be heated more based on the ambient environment than the other electrode. In such case, the above-mentioned power ratio C does not always turns into 1/1. In addition, since the heating amount difference between one electrode and the other electrode when the lamp is horizontally arranged is smaller than the difference between when the lamp is vertically arranged, a ratio A"/B" is set to be larger than an electric energy ratio A"/B" in case where the lamp described below is vertically arranged. B" represents electric energy that flows from the electrode arranged on the mirror side of the lamp to the other electrode, and A" represents electric energy that flows from the other electrode to the electrode arranged on the mirror side, A similar example to the above-mentioned reflective mirrors case is where a light source apparatus is equipped with an optical element that returns light to the inside of an arc tube. That is, when light passes through a color wheel, part of that light is reflected and returned to the arc tube. Another example is when one of sealing portions is provided with a first reflective mirror so that light is reflected in a light emitting direction, and the other sealing portion is provided with a second reflective mirror so that the light is reflected in a direction opposite to the light emitting direction. In the lighting method of the above-mentioned A and B, a desirable range (i.e. extent to which it does not have an adverse effect on electrodes) of insertion times (frequency) of the low frequency at time of vertical arrangement (relative value) corresponds to the power ratio of the low frequency at the time of vertical arrangement. In addition, the above insertion times (frequency) of the low frequency at the time of vertical arrangement (relative value) means the ratio of the insertion times (frequency) of the low frequency at the time of the vertical arrangement, to the insertion times (frequency) of the low frequency at the time of the horizontal arrangement. That is, [the low frequency insertion period at the time of vertical arrangement (frequency)]/[low frequency insertion period at the time of horizontal arrangement (frequency)]. For example, the insertion times (relative value) of the low frequency applied to an upper electrode is denoted as "$\alpha/100/\beta\times\gamma$", when the duty ratio at low frequency is represented as $\alpha$, the low frequency (Hz) is represented as $\beta$, and the insertion times for a certain fixed period is represented as $\gamma$ (times).

Figures 4A, 4B:
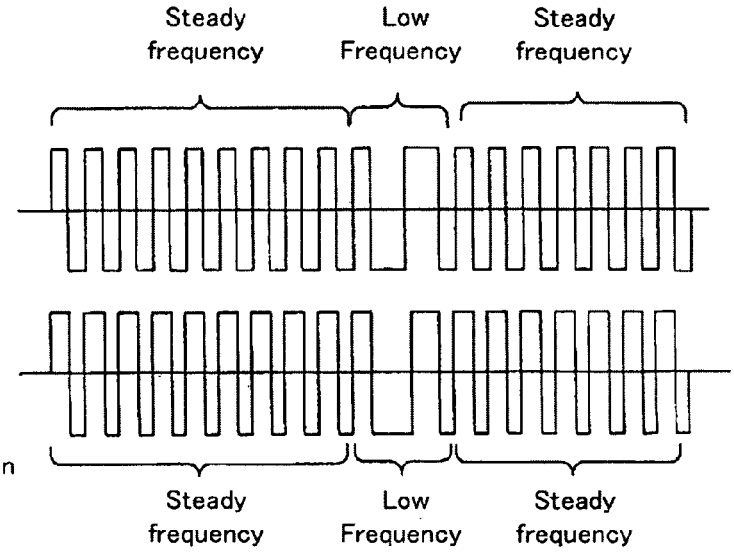
FIGS. 4A and 4B are diagrams showing a current waveform (1) of a light source apparatus.

Description of the lighting methods A and B will be given below. First, description of when a lamp is turned on in the vertical arrangement using method A, wherein the power ratio at time of steady frequency and at time of low frequency is set so as to be different from the power ratio at the time of horizontal arrangement. FIGS. 4A and 4B show examples of a current waveforms that flows into the lamp when a lamp is lighted by the lighting method A, and the power ratio is set to a predetermined value By changing a duty ratio (ratio of on time and on time+off time). FIG. 4A shows current waveforms where a lamp is horizontally arranged, and FIG. 4B shows current waveforms where a lamp is vertically arranged. As shown in FIGS. 4A and 4B, in the case of horizontal arrangement, polarity change cycle at steady frequency is approximately 1:1 (the power ratio C=approximately 1/1), and also the polarity change cycle at low frequency is approximately 1:1 (the power ratio C=approximately 1/1). On the other hand, in case of the vertical arrangement, the polarity change cycle at steady lighting frequency is approximately 4:6 (the power ratio D is 4/6), and also the polarity change cycle at low frequency is approximately 4:6 (the above-mentioned power ratio E is 4/6). In addition, the insertion frequency (relative value) of the low frequency of this example is 1.1. Thus, if the polarity change cycle of low frequency is changed while the polarity change cycle in steady lighting frequency at the time of the vertical arrangement is changed, heating of the upper side electrode can be suppressed whereby loss and damages to the upper side electrode can be suppressed. In addition, it is possible to suppress the generation of an unnecessary projections on both upper and lower side electrodes.

When lighting by the waveform shown in FIGS. 4A and 4B, the above mentioned light source apparatus shown in FIG. 3 is controlled as set forth below. The detection circuit 30 detects a state of the lamp (horizontally arrangement or vertical arrangement) according to the arrangement state of the discharge lamp 10, and outputs the result to the control circuit 50. The control circuit 50 performs control according to whether the lamp 10 is horizontally arranged or vertically arranged, as set forth below.

In the case of horizontally arrangement (horizontal lighting), when the lamp 10 is horizontally arranged, since the pair of electrodes face each other in the horizontal direction in the high pressure discharge lamp 10, the one electrode and the other electrode are heated in approximately the same degree due to a heat convection produced inside an arc tube. For this reason, when alternating current is supplied to the electrodes, so that the electric energies flowing between the electrodes may become approximately the same, the pair is heated to approximately the same degree. Thus, heating of only one of these electrodes is suppressed, which makes it possible to suppress loss and damages to both electrodes.

For this reason, a signal, which indicates a horizontal state of the lamp 10, is inputted in the control circuit 50 from the detection circuit 30, as shown in FIG. 4A. Thus, the control circuit 50 controls the power supply apparatus 20, so that the electric energy flowing from the one electrode to the other electrode and the electric energy flowing from the other electrode to the one electrode, are approximately the same. That is, the control circuit 50 performs control so that the ratio A/B of the electric energy b, which flows to the one electrode from the other electrode of the lamp 10, to the electric energy a, which flows from the one electrode to the other electrode, may be set to approximately 1. In addition, when the voltage impressed to the lamp is approximately constant, the above-mentioned electric energy is approximately proportional to the current that flows between the electrodes of the lamp. FIGS. 4A and 4B respectively show current waveforms, which flow between the electrodes of the lamp, wherein when the lamp voltage is approximately constant, the current waveform is approximately in agreement with electric power waveform, and when the lamp electric power is controlled by constant power control so that the electric power may be constant, the amplitude of current waveform becomes approximately constant, as shown in the figure.

In the circuit shown in FIG. 3, as mentioned above, the electric power control unit 52*c* of the control unit 50 controls the switching element Qx of the step down chopper circuit 1 according to a signal given from the detection circuit 30, which indicates that the lamp 10 is horizontally arranged, so that the electric energy flowing from the one electrode to the other electrode and the electric energy flowing from the other electrode to the one electrode may become approximately the same. Moreover, in case where the drive signal generation unit 51 of the control unit 50 is given a synchronization signal from the time division element 40, the driver 4 is driven according to this synchronization signal, and the switching cycle of the switching elements Q1-Q4 of the full bridged circuit 2 is controlled, so that the polarity change of the electric power, which flows into the lamp 10, is performed in synchronization with the synchronization signal. As a result, alternating current is supplied so that the electric energy flowing from the one electrode to the other electrode, and the electric energy flowing from the other electrode to the one electrode may become approximately the same.

When the lamp is vertically arranged (vertical lighting), as shown in FIG. 2, the pair of electrodes provided in the lamp are also vertically arranged. Thus, a first or one electrode (upper side electrode) and a second or other electrode 14*b* (lower side electrode) are arranged in the gravity direction (in an up and down direction in FIG. 2). When the electrodes are arranged in the gravity direction, the electrode located in the upper side gets hot at time of lamp lighting, since a heat convection arises inside an arc tube. Thus, the one electrode 14*a* becomes hotter than the other electrode 14*b*. As mentioned above, the amount of heating to electrodes becomes larger as electric energy, which is sent out from the electrode becomes larger. Therefore, when alternating current electric power (current) is supplied, so that the electric energy flowing from the one electrode 14*a* to the other electrode 14*b* may become smaller than the electric energy flowing from the other electrode 14*b* to the one electrode 14*a*, and the amount of heating to the one electrode 14*a* can be made smaller than that of the other electrode 14*b*. Thus, even if the vertically arranged lamp is lighted and the one electrode 14*a* is heated by the heat convection, the amount of heating to the one electrode 14*a* can be suppressed based on electric energy supplied to that electrode. Thus, loss and damages to the one electrode 14*a* may be suppressed.

For this reason, when a signal, which indicates a state where the lamp 10 is vertically arranged, is inputted in the control circuit 50 from the detection circuit 30, the control circuit 50 controls, the power supply apparatus 20 as shown in FIG. 4B, so that the electric energy flowing from the electrode arranged in the upper side to the electrode arranged in the lower side may become smaller than the electric energy flowing from the electrode arranged in the lower side to the electrode arranged in the upper side. In addition, in FIG. 4B, a plus side shows current that flows from the electrode arranged in the upper side to the electrode arranged in the lower side and a minus side shows current that flows from the electrode arranged in the lower side to the electrode arranged in the upper side, (they are the same as those in the following figures showing waveforms). In case where the lamp 10 is vertically arranged, while the control unit 50 changes the polarity change cycle at steady lighting frequency, so that the electric energy flowing from the electrode arranged in the upper side to the electrode arranged in the lower side may become smaller than the electric energy flowing from the electrode arranged in the lower side to the electrode arranged in the upper side, the control unit 50 changes the polarity change cycle at low frequency.

In the circuit of FIG. 3, when the drive signal generation unit 51 of the control unit 50 is given a synchronization signal from the time division element 40, the driver 4 is driven according to this synchronization signal and the switching cycle of the switching elements Q1-Q4 of the full bridged circuit 2 is controlled. And according to a signal indicating a state where the lamp 10 is vertically arranged, the polarity change of the electric power flowing through the lamp 10 is performed in synchronization with the synchronization signal, so that the electric energy flowing from the electrode arranged in the upper side to the electrode arranged in the lower side may become smaller than the electric energy flowing from the electrode arranged in the lower side to the electrode arranged in the upper side. As a result, alternating current is supplied, so that the electric energy flowing from the electrode arranged in the upper side to the electrode arranged in the lower side, becomes smaller than the electric energy flowing from the electrode arranged in the lower side to the electrode arranged in the upper side, whereby heating of the upper side electrode is suppressed.

Figure 5A:
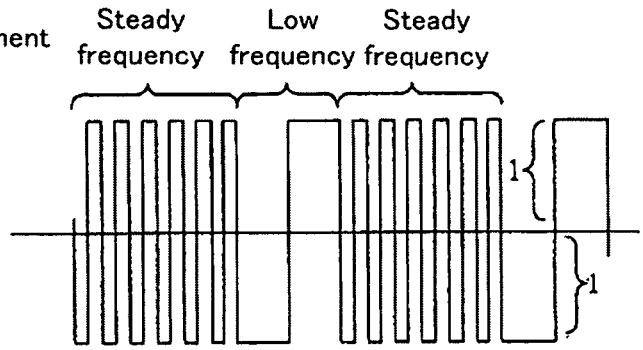
FIGS. 5A and 5B are diagrams showing a current waveform (2) of a light source apparatus.
Figure 5B:
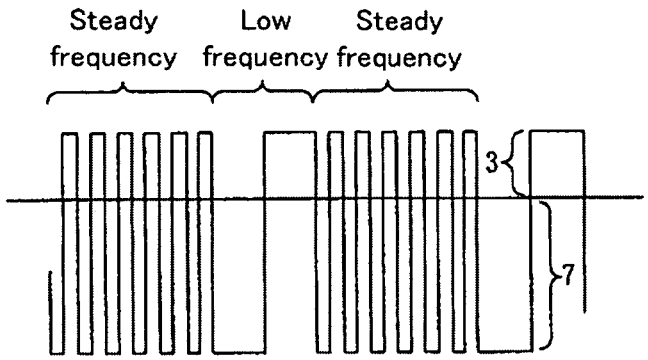

Although FIGS. 4A and 4B show the case where the control is performed so that the electric energy flowing from the electrode arranged in the upper side to the electrode arranged in the lower side may become smaller than the electric energy flowing from the electrode arranged in the lower side to the electrode arranged in the upper side, by changing the polarity change cycle, i.e., a duty ratio, in the case of lighting by the lighting method of A, a waveform as shown in FIGS. 5A and 5B may be used. Similarly to FIGS. 4A and 4B, FIGS. 5A and 5B show an example of a current waveform that flows through a lamp, where in the vertical arrangement, the magnitude of the current on the plus side and that of the current on the minus side are changed, so that the electric energy flowing from the electrode arranged in the upper side to the electrode arranged in the lower side may become smaller than the electric energy flowing from the electrode arranged in the lower side to the electrode arranged in the upper side. FIG. 5A shows a current waveform in a case where a lamp is horizontally arranged, and FIG. 5B shows a current waveform in a case where a lamp is vertically arranged. In addition, as mentioned above, a plus side shows current flowing from the electrode arranged in the upper side to the electrode arranged in the lower side, and a minus side shows current flowing from the electrode arranged in the lower side to the electrode arranged in the upper side.

Similarly to FIGS. 4A and 4B, FIGS. 5A and 5B show a case where in the horizontal arrangement, the polarity change cycle at steady frequency is approximately 1:1, and the polarity change cycle at low frequency is also approximately 1:1. On the other hand, in the case of vertical arrangement, at steady lighting frequency, the above-mentioned power ratio D is 3/7, and the above-mentioned power ratio E is 3/7 at low frequency. Thus, similarly to the horizontal arrangement, while a duty ratio, which is approximately 1:1, is maintained in the case of vertical arrangement, it is possible to change a current value, so that the same effects in the cases of FIGS. 4A and 4B can be acquired. In a circuit of FIG. 3, control is performed, so that the electric energy, which flows from the electrode arranged in the upper side to the electrode arranged in the lower side may become smaller than the electric energy, which flows from the electrode arranged in the lower side to the electrode arranged in the upper side. At the time of horizontal arrangement, as mentioned before, the electric power control unit 52*c* of the control unit 50 controls the switching element Qx of the step down chopper circuit 1 according to a signal given from the detection circuit 30, which indicates that the lamp 10 was horizontally arranged, so that the electric energy flowing from the one electrode to the other electrode and the electric energy from the other electrode to the one electrode may become approximately the same as each other. Moreover, in case where the drive signal generation unit 51 of the control unit 50 is given the synchronization signal from the time division element 40, the driver 4 is driven according to this synchronization signal, and the switching cycle of the switching elements Q1-Q4 of the full bridged circuit 2 is controlled, so that the polarity change of the electric power flowing into the lamp 10 is performed in synchronization with the synchronization signal. As a result, alternating current is supplied so that the electric energy flowing from the one electrode to the other electrode and the electric energy flowing from the other electrode to the one electrode may become approximately the same as each other.

At the time of vertical arrangement, as mentioned before, the electric power control unit 52*c* of the control unit 50 controls the switching element Qx of the step down chopper circuit 1 according to the signal given from the detection circuit 30, which indicates that the lamp 10 is vertically arranged, so that the electric energy flowing from the electrode arranged in the upper side to the electrode arranged in the lower side may become smaller than the electric energy flowing from the electrode arranged in the lower side to the electrode arranged in the upper side.

Moreover, in case where the drive signal generation unit 51 of the control unit 50 is given a synchronization signal from the time division element 40, the driver 4 is driven according to this synchronization signal, and the switching cycle of the switching elements Q1-Q4 of the full bridged circuit 2 is controlled, so that the polarity change of the electric power flowing into the lamp 10 is performed in synchronization with the synchronization signal. As a result, alternating current is supplied, so that the electric energy flowing from the electrode arranged in the upper side to the electrode arranged in the lower side becomes smaller than the electric energy flowing from the electrode arranged in the lower side to the electrode arranged in the upper side whereby heating of the upper side electrode is suppressed.

In the lighting method of A which is described above, the power ratio of the steady frequency of vertical arrangement, is different from the power ratio at the time of the steady frequency in horizontal arrangement. That is, as long as the electric energy, which is sent out from an upper electrode, becomes smaller than the electric energy sent out to the upper electrode from the lower electrode, a duty ratio may be changed as shown in FIGS. 4A and 4B, or a current value may be changed as shown in FIGS. 5A and 5B. Moreover, both the duty ratio and the current value may be changed. Similarly, the power ratio of the low frequency of vertical arrangement is different from the power ratio at the time of the low frequency in the horizontal arrangement. That is, as long as the electric energy, which is sent out from the upper electrode to the lower electrode is smaller than the electric energy sent out from the lower electrode to the upper electrode, a duty ratio or a current value may be changed. Moreover, both the duty and the current value may be changed. In addition, in the lighting method A, when a current value is changed, as shown in the FIGS. 8A and 8B (FIG. 1 of Japanese Patent Application Publication No. 2002-015883), which is described later, the current value At one polarity may be changed.

Figure 6A:
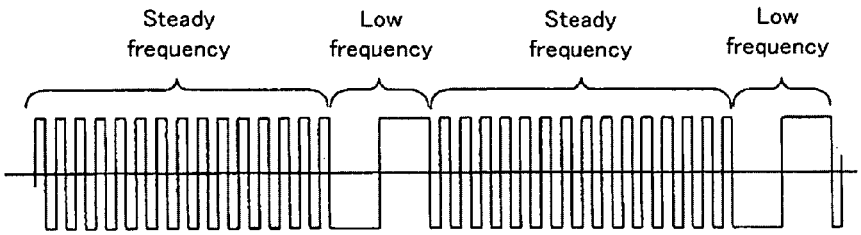
FIGS. 6A and 6B are diagrams showing a current waveform (3) of a light source apparatus.
Figure 6B:
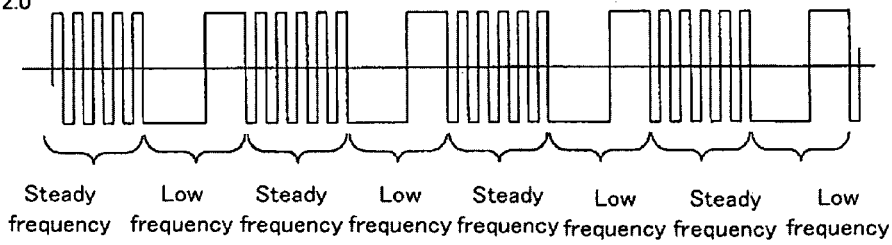

Next, description will be given below where a lamp is lighted so that only the power ratio of a low frequency at time of vertical arrangement is different from that at time of horizontal arrangement as in the above-described method B. FIGS. 6A and 6B show one of examples of a current waveform that flows through a lamp, where the lamp is lighted by the lighting method B, where a power ratio is set to a predetermined value By changing a duty ratio. That is, in this example, the power ratio is set to the predetermined value By changing the duty ratio (ratio of "ON time" and "ON time+OFF time"). FIG. 6A shows a current waveform where the lamp is horizontally arranged, and FIG. 6B shows where the lamp is vertically arranged.

As shown in FIGS. 6A and 6B, in the case of the horizontal arrangement, the polarity change cycle at steady frequency is approximately 1:1 (the above-mentioned power ratio C is approximately 1/1), and also the polarity change cycle at low frequency is approximately 1:1 (the above-mentioned power ratio C is approximately 1/1). On the other hand, in the case of vertical arrangement, the polarity change cycle at steady lighting frequency is approximately 1:1 (the above-mentioned power ratio D is 1/1), and the polarity change cycle at low frequency is approximately 4:6 (the above-mentioned power ratio E is 4/6). In addition, insertion frequency (relative value) of the low frequency in this example is 2.0. Thus, by changing the polarity change cycle at the low frequency in the case of vertical arrangement, heating of the upper side electrode can be suppressed whereby damage is suppressed. Furthermore, it is possible to suppress the generation of an unnecessary projection on both electrodes. In addition, the operation of the control unit 50 in the case of lighting with the waveform shown in FIGS. 6A and 6B is the same as that in lighting with the waveform shown in FIGS. 4A and 4B.

Figure 7A:
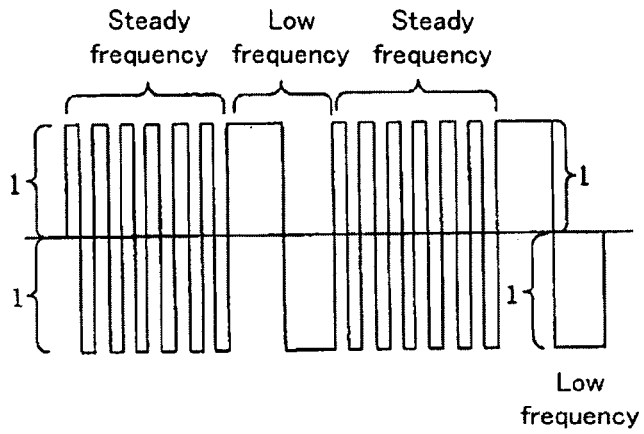
FIGS. 7A and 7B are diagrams showing a current waveform (4) of a light source apparatus.
Figure 7B:
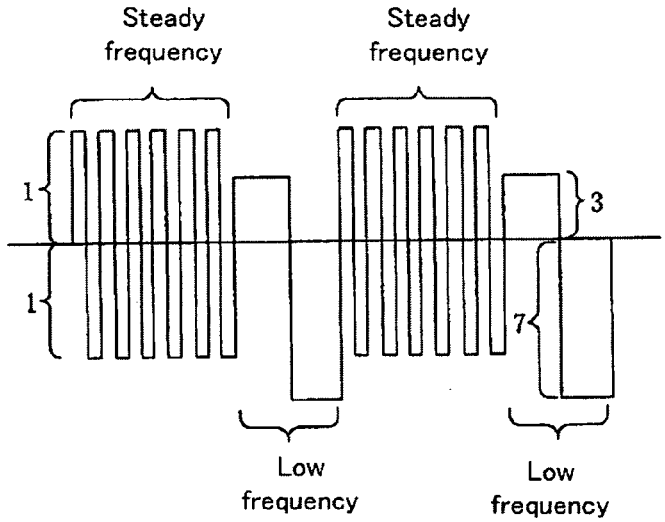

Although FIGS. 6A and 6B show where the power ratio is set to the predetermined value By changing the polarity change cycle, i.e., the duty ratio, as shown in FIGS. 7A and 7B, and similarly to the case of the horizontal arrangement, while the duty ratio is maintained to be approximately 1:1, a current value may be changed, wherein the same effects as those of the case shown in FIGS. 6A and 6B can be obtained. FIG. 7A shows a current waveform where a lamp is horizontally arranged, and FIG. 7B shows where the lamp is vertically arranged. As in FIGS. 6A and 6B, FIGS. 7A and 7B show where in the horizontal arrangement, the above mentioned power ratio C at a steady frequency and at a low frequency is approximately 1/1. In the case of vertical arrangement, at the steady frequency the above-mentioned power ratio D is 1/1, and at the low frequency the above-mentioned power ratio E is 3/7. Thus, similarly to the horizontal arrangement, while in the case of the vertical arrangement a duty ratio at the low frequency is kept at approximately 1:1, and a current value may be changed, so that the same effects shown in FIGS. 6A and 6B can be obtained. In addition, operation of the control unit 50 in the case of lighting by the waveform in FIGS. 7A and 7B is the same as that in lighting by the waveform shown in FIGS. 5A and 5B.

In the case of the above-mentioned lighting method B, the power ratio at steady frequency in the vertical arrangement is the same as that of at the time of the steady frequency in horizontal arrangement. On the other hand, in the lighting method B, the power ratio at the low frequency in the case of vertical arrangement differs from that of the low frequency in the case of horizontal arrangement. In this case, if the electric energy is sent out to a lower electrode from an upper electrode is smaller than the electric energy is sent out to the upper electrode from the lower electrode, even though a duty ratio may be changed as shown in FIGS. 6A and 6B, a current value may be changed as shown in FIGS. 7A and 7B., or both the duty and the current value may be changed. In addition, when the current value is changed in the lighting method B, as shown in the FIGS. 8A and 8B, the current value may be changed during one polarity period.

Figure 8A:
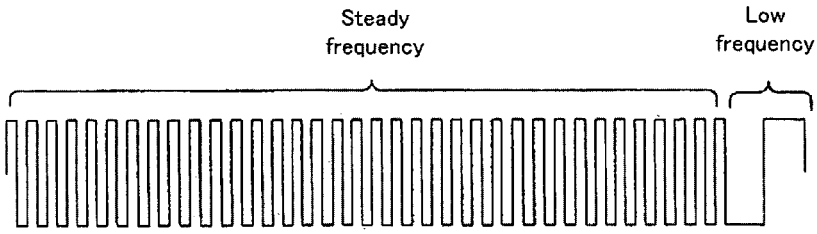
FIGS. 8A and 8B are diagrams showing a current waveform (5) of a light source apparatus.
Figure 8B:
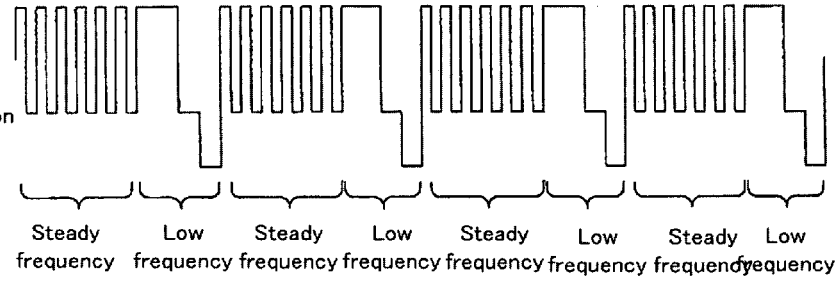

FIG. 8A shows a current waveform where a lamp is horizontally arranged, and FIG. 8B shows the lamp vertically arranged. FIGS. 8A and 8B also show where in a horizontal arrangement, the above mentioned power ratio C at a steady frequency and at a low frequency is approximately 1/1. In the case of vertical arrangement, at a steady frequency the above-mentioned power ratio D is 1/1', and at a low frequency the current value is increased for a short time during one polarity period, wherein the power ratio E is 4/6. In addition, insertion frequency (relative value) of the low frequency in this example is 4.0. Thus, as in the case of the horizontal arrangement, in the case of the vertical arrangement, while the duty ratio is maintained to be approximately 1:1, a current value may be changed, wherein the same effects as those of the case shown in FIGS. 7A and 7B can be obtained. As mentioned above, heating of both electrodes can be suppressed by controlling the electric energy flowing through the lamp, so that loss/damage to the both electrodes can be suppressed. Furthermore, as described above, it is possible to suppress the generation of unnecessary projections on electrodes by inserting low frequency waveform.

Next, description of a synchronization signal inputted into the control circuit 50 from the time division element 40, when a color wheel is used will be given below. As disclosed in Japanese Patent Application Publication No. 2007-165067, in the light source apparatus according to the present invention, light outputted from, the lamp may be emitted toward such a color wheel. The color wheel may also be, more specifically, a rotation filter and made from disk-like glass. That is, areas of red (R), green (G), blue (B), and white (W) are formed in the filter in shape of a fan, respectively. The light outputted from the lamp passes through a light collecting area, which is formed on the color wheel. While the color wheel is rotated, the light passes through a color area, which faces the light collecting area, so that each color is emitted. Here, for example, when the color wheel is rotated at 180 Hz (180 revolutions per second), such that the light passes through each of red (R), green (G), blue (B), and white (W) areas by 180 times per second.

Figure 9A:
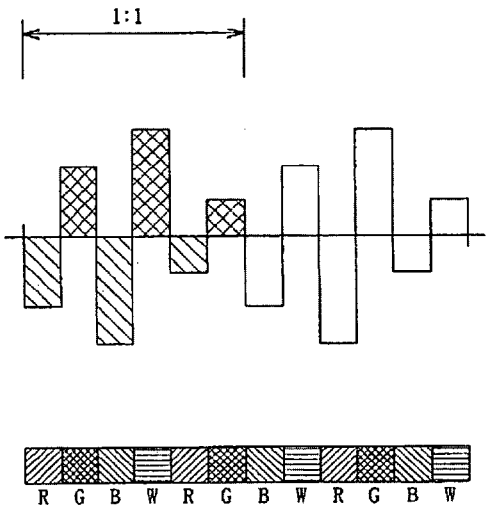
FIGS. 9A and 9B are timing charts of a current waveform of a light source apparatus and a color wheel.
Figure 9B:
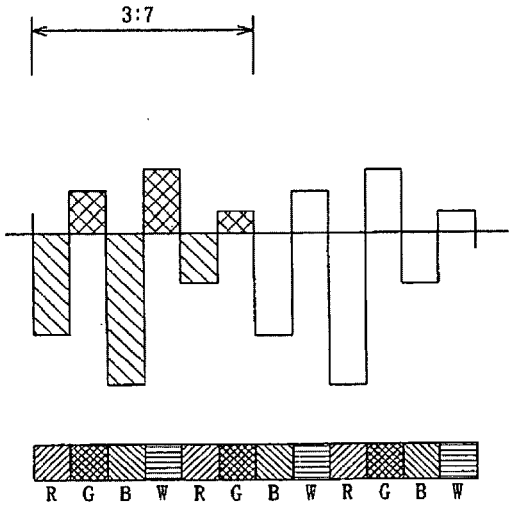

When the color wheel is used in this way, as mentioned above, it is desirable to change the polarity of the alternating current electric power (current) flowing through the lamp at each area change timing, in order not to produce a flicker on a screen. In the light source apparatus shown in FIGS. 1 and 3, a synchronization signal in synchronization with each area change timing of the color wheel is inputted into the control unit 50 from the time division element 40. The control unit 50 drives the driver 4 according to the above-mentioned synchronization signal, and the switching cycle of the switching elements Q1-Q4 of the full bridged circuit 2 is controlled, whereby the polarity change of the electric power flowing through the lamp 10 is performed in synchronization with the synchronization signal. FIGS. 9A and 9B show current, which flows between electrodes of a lamp and area change timing of each of the R, G, B, and W areas of a color wheel, wherein the duty ratio of the current flowing through the lamp is set to 1:1. As shown in FIGS. 9A and 9B, when such a color wheel is used, the polarity of the alternating current electric power (current) flowing through the lamp is switched in synchronization with the area change timing of the color wheel. In addition, FIG. 9A shows that the power ratio is 1/1 in a horizontal lighting with a current waveform at steady frequency. FIG. 9B shows that the power ratio is not 1/1 in a vertical lighting (power ratios 3/7) with a current waveform at steady frequency.

That is, as shown in FIG. 9A, when the lamp is horizontally arranged, while the polarity of the alternating current electric power (current) flowing through the lamp is switched in synchronization with the area change timing of the color wheel, control is performed so that electric energy flowing from one electrode to the other electrode is set to be approximately the same as the electric energy flowing from the other electrode to the one electrode. In addition, in FIG. 9A, although the duty ratio of the current flowing through the lamp is set to 1:1, a vertical axis, that is, the current amount differs depending on cycles. This is because the current amount for each color wheel color is changed to adjust the color reproducibility of an image, which is formed by passing through the color wheel, or brightness. That is, the current amount of red (R) or blue (B) with respect to the image to be formed, is improved to improve the color reproducibility of the image, and the current amount of green (G) or white (W) is improved to improve the brightness, so that the current varies in each cycle. Even if current varies in each cycle, since the electric energy flowing from the one electrode to the other electrode is set to be approximately equal to the electric energy flowing the other electrode to the one electrode in a predetermined period, the electric energy per unit time that flows from the one electrode to the other electrode becomes approximately equal to the electric energy that flows through the other electrode to the one electrode. That is, in FIG. 9A, the total area of the plus side with hatching and that of the minus side with another hatching are approximately equal. In addition, as mentioned above, in this case, the electric energy that flows from the other electrode to the one electrode may be set to be slightly larger than the electric energy that flows from the one electrode to the other electrode whereby the electrodes are heated to approximately the same degree.

Moreover, as shown in FIG. 9B, when the lamp is vertically arranged, while the polarity of the alternating current electric power (current) flowing through the lamp is changed in synchronization with the area change timing of the color wheel, control is performed so that the electric energy that flows from the electrode arranged in the upper side to the electrode arranged in the lower side becomes smaller than the electric energy that flows from the electrode arranged in the lower side to the electrode arranged in the upper side. Moreover, as described above, a ratio of the electric energy b' that flows from an electrode arranged in the lower side of the lamp to the electrode arranged in the upper side to electric energy A' that flows from the electrode arranged in the upper side to the electrode arranged in the lower side is represented as D (=A'/B') and is set so as to be smaller than a ratio C (ratio of electric energy flowing to one electrode from the other electrode to electric energy flowing to the other electrode from the one electrode in a case where the lamp is horizontally arranged).

In addition, in FIG. 9B, although the duty ratio of current that flows through a lamp is set to 1:1, a vertical axis, that is, the current amount varies depending on cycles, similarly to those of FIG. 9A. This is because the figure shows the lamp current in the case where the lamp voltage changes as described above. In this case, in the electric energy in each cycle, to suppress loss/damage to the electrodes, electric flowing from the electrode arranged in the upper side to the electrode arranged in the lower side becomes smaller than the electric energy flowing from the electrode arranged in the lower side to the electrode arranged in the upper side. In this case, for example, the ratio of the electric energy flowing from the electrode arranged in the upper side to the electrode arranged in the lower side to the electric energy flowing from the electrode arranged in the lower side to the electrode arranged in the upper side is set to 3:7, and the electric energy per unit is set to 3:7, in the same manner as the current amount.

That is, the ratio of the area of minus side with the hatching and that of the plus side with another hatching shown in FIG. 9B is set to 3:7. As described above, loss/damage to both electrodes can be suppressed by controlling the electric energy that flows through the lamp. Moreover, it is possible to match timing of current polarity change with area change timing of areas of the color wheel, so that an image can be displayed without producing a flicker on a screen.

Figure 10A:
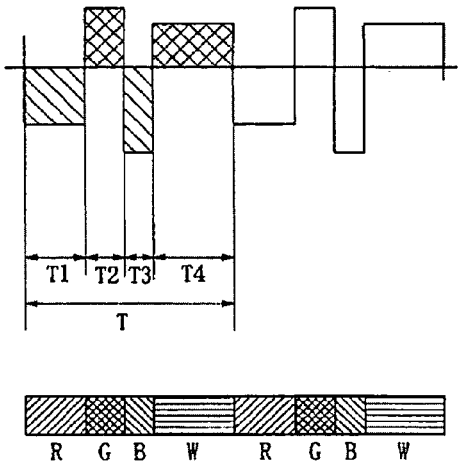
FIGS. 10A and 10B are timing charts of a current waveform of a light source apparatus and a color wheel.
Figure 10B:
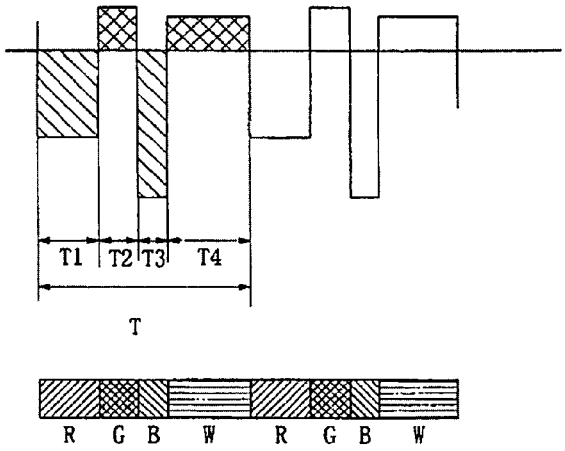

In addition, the width of the color wheel segments are not necessarily fixed. That is, as shown in FIGS. 10A and 10B, there are wide areas (R and W in the figure), and narrow areas (G and B in the figure). For example, in FIGS. 10A and 10B, time T is set to one cycle and time width of each area is set to T1, T2, T3, and T4. In this case, it is desirable to perform the polarity change of lamp current according to area change timing of the color wheel. In this case, a duty ratio is not necessarily 1:1. For this reason, in the case of horizontal lighting, timing of polarity change of the lamp current is controlled according to the width of each segment of the color wheel. Moreover, control is performed so that the electric energy that flows from one electrode to the other electrode is set to be approximately the same as the electric energy that flows from the other electrode to the one electrode. For example, in FIG. 10A, the current amplitude flowing from one electrode to the other electrode and the current amplitude flowing from the other electrode to the one electrode are controlled within one cycle T of R, G, B, and W, so that the electric energy that flows from one electrode to the other electrode is set to be approximately the same as the electric energy that flows from the other electrode to the one electrode.

Moreover, although at time of vertical lighting, polarity change timing is controlled according to the width of the segment of the color wheel to be the same as the case of horizontal lighting, as described above, and at the same time, control is performed, within one cycle T of R, G, B, and W in FIG. 10B, so that the electric energy flowing from the electrode arranged in the upper side to the electrode arranged in the lower side becomes smaller than the electric energy flowing from the electrode arranged in the lower side to the electrode arranged in the upper side. For example, in FIG. 10B, the ratio of the current amount that flows from an electrode arranged in the upper side to an electrode arranged in a lower side to the current amount that flows from the lower electrode to the upper electrode is set to 3:7 in each cycle T.

The electric energy per unit time is also set to, for example, 3:7 in the same manner as the current amount. That is, the ratio of the area of the minus side with hatching and that of the plus with another hatching shown in FIG. 10B is set to 3:7. Thus, for example, when the color wheel is used, a duty ratio is not necessarily 1:1, and it is necessary to define a duty ratio in accordance with the area change timing of each segment of the color wheel; and as shown in FIGS. 10A and 10B, a duty ratio at time of horizontal lighting and that at time of vertical lighting are in agreement, and the polarity change timing of current is matched with area change timing of a color wheel. Moreover, at the same time, while the electric energy at the time of horizontal lighting is controlled to be approximately 1:1, the electric energy at steady frequency in the case of vertical lighting is controlled to be, for example, approximately 3:7. Thereby, loss and damage to the electrodes may be suppressed.

In order to confirm the effects of the present invention, an experiment was conducted, as set forth below.

Experimental Result 1

An experiment, in which a lamp was lighted by the method A, was conducted to examine a range of a period of a low frequency (or degree of repetition) in the case of vertical arrangement, which was more desirable than a period of a low frequency (or degree of repetition) in the case of horizontal arrangement. The maximum outer diameter of a silica glass discharge tube of the lamp used for the experiment was $\phi$11.3 mm. In a light emission section, mercury of 0.29 mg/mm$^3$, bromine gas of $3\times10^{-3}$ μmol/mm$^3$, and rare gas of 100 Torr were enclosed, and a distance between electrodes was 1.1 mm. In the case of vertical arrangement, the lamp was lighted for two hundred hours, under lamp lighting conditions where steady lighting frequency was set to 370 Hz, and the low frequency was set to 46 Hz. At this time, a power ratio at steady frequency and low frequency in the case of horizontal arrangement lighting (a ratio of an electric energy that flows from a first electrode arranged in one side (an upper side) to a second electrode arranged in the other side (a lower side) to an electric energy that flows from the second electrode arranged in the other side (the lower side) to the first electrode arranged in the one side (the upper side)), was set to 50/50 (equivalent to the power ratio C). An electric power ratio at steady frequency in the case of vertical arrangement lighting and that of low frequency were changed respectively, as explained as to the method A above, that is, the lamp was lighted at a low frequency power ratio of 20/80, 25/75, 30/70, 35/65, 40/60, 45/55, and 50/50, respectively, wherein the low frequency insertion period (degree of repetition) (relative value) was changed in each electric power ratio. In addition, although in the case of vertical arrangement, it is set to [the electric power ratio D at time of lighting at steady frequency]=[electric power ratio at time of lighting at low frequency], "D" is not necessarily equal to "E", and even if it is set to D≠E, it is considered that the same result could be obtained.

In the case of horizontal arrangement, the insertion time (degree of repetition) (relative value) of the low frequency was set so that the low frequency was inserted for 1,000 seconds every 100 minute lighting at steady lighting frequency. This was a reference set. In the case where the low frequency was inserted for 1,000 seconds every time lighting was performed for 100 minutes at steady lighting frequency in the case of vertical arrangement, the insertion period was set to "1" with respect to the above reference. When the low frequency, which was ten percent longer than the reference, that is, 1,100 sec was inserted every time lighting was performed for 100 minutes lighting at steady lighting frequency, the insertion period was set to "1.1", so that the lamp was lighted by various insertion periods (degree of repetition) (relative value). The electrodes were observed after the lamp was lighted for two hundred hours with the low frequency insertion period (degree of repetition) (relative value), wherein a symbol "o" is given to cases where a tip shape does not have unusual consumption or deformation (where 70 percent or more of the life time of the electrodes in the case of horizontal lighting could be secured), and NG is given to cases where the tip shape has unusual consumption or deformation (less than 70 percent of the life time thereof).

FIGS. 11A, 11B, and 11C show a summarized experimental result. FIG. 11A shows a table in which the quality of the electrodes incase of changing the low frequency insertion period (which is referred to as "Low frequency insertion frequency" in FIG. 11A) in each electric power ratio (which is referred to as "Duty ratio" in FIG. 11A), wherein the positions of no good electrodes and the causes thereof in case where the electrodes were considered as no good, were filled in. The electric power ratio (Duty ratio) was changed in a range from 20/80 to 50/50, and the shapes of the electrodes in the insertion period of each low frequency were observed. In FIG. 11A, for example, "A: Upper/Lower: Low" in the case of where "Duty ratio" was 25/75 when the low frequency insertion period was 0.3, means that it was considered that both the upper and lower electrodes were no good, since both electrodes temperature became low, whereby unnecessary projection(s) was formed. Moreover, "B: "Upper: Low" means a case where the upper electrode was no good and the temperature of the upper electrode became low. "C: Lower: Low" means a case where the lower electrode was no good and the temperature of the lower electrode was low. "D: Upper/Lower: High" means a case where both of the upper and lower electrodes are no good, and the temperature of the both electrodes became high, whereby the projections melted. "E: Upper: High" means a case where the upper electrode is no good, and the temperature of the upper electrode became high, whereby the projections melted, and "F: Lower: High" means a case where the lower electrode was no good and the temperature of the lower electrode became high, whereby the projections melted. In the table of FIG. 11A, in the cases where the electric power ratios were 25/75 and 30/70, the electric energy, which was sent out to the lower electrode, was relatively larger than the electric energy, which was sent out to the upper electrode. For this reason, if the low frequency insertion period (degree of repetition) was made longer, a period, in which the lower electrode was heated, became longer so it melted. For this reason, in the case where the electric power ratio was 25/75, the low frequency insertion period was set to 1.4 or less, and in the case where the electric power ratio was 30/70, it was set to 1.5 or less, whereby it was necessary to shorten the heating time during which the lower electrode was heated. Moreover, in cases where the electric power ratios were 25/75 and 30/70, the electric energy, which was sent out from the upper electrode, was relatively smaller than the electric energy, which was sent out from the lower electrode. For this reason, if the low frequency insertion period was made shorter, a period, in which the upper electrode was heated, became short, so that an unnecessary projection (s) were generated. For this reason, in the case where the electric power ratio was 25/75, the low frequency insertion period was set to 0.55 or more, and in the case where the electric power ratio was 30/70, it was set to 0.45 or more, whereby it was necessary to make the heating period longer, in which the upper electrode was heated.

In the table of FIG. 11A, although when the low frequency insertion period was 1.45 in the case where the electric power ratio was 30/70, the result was good electrodes as indicated as "○" in the figure, when the low frequency insertion period was 1.45 in the case where the electric power ratio was 25/75 and when the low frequency insertion period was 1.45 in case where the power ratio was 35/65, the results were no good electrodes, respectively. Comparing the case where the low frequency insertion period was 1.45 when the power ratios was 30/70 with the case where the low frequency insertion period was 1.45 when the power ratio was 25/75, since electric energy that was sent out from the lower electrode became larger, the temperature of the lower electrode became high and it melted. For this reason, when the low frequency insertion period in the case where the electric power ratio was 25/75 was set to 1.4, which was shorter than 1.45 (which was the low frequency insertion period was 30/70), a period, in which the lower electrode was heated, became shorter so that it was possible to avoid a problem of melting. Comparing the case where the low frequency insertion period was 1.5 when the power ratio was 30/70, with the case where the low frequency insertion period was 1.5 when the power ratio was 35/65, since in the case where the power ratio was 35/65, electric energy that was sent out from the upper electrode became larger, the temperature of the upper electrode became high whereby it melted. For this reason, when the low frequency insertion period in the case where the electric power ratio was 35/65 was set to 1.45, which was shorter than 1.5 (which is the low frequency insertion period 30/70), a period, in which the upper electrode was heated, became shorter so that it was possible to avoid melting the electrode. In addition, the low frequency insertion period became shorter in the order of the power ratios 35/65, 40/60, and 45/55 because the electric energy that was sent out from the upper electrode increased as mentioned above.

In the table of FIG. 11A, although when the low frequency insertion period was 0.4 in the case where the electric power ratio was 35/65, the result was good electrodes as indicated as "○" in the figure. When the low frequency insertion period was 0.4 in the case where the electric power ratio was 30/70 the result was no good. Comparing the case where the low frequency insertion period was 0.4 when the power ratios was 35/65, with the case where the low frequency insertion period was 0.4 when the power ratio was 30/70, electric energy that was sent out from the upper electrode became small, so that the temperature of the upper electrode became low, whereby unnecessary projections formed. For this reason, when the low frequency insertion period in the case where the electric power ratio was 30/70 was set to 0.45, which was longer than 0.4 (which is the low frequency insertion period 35/65), a period, in which the upper electrode was heated, became longer so that it was possible to melt the unnecessary projections. In addition, the low frequency insertion period became shorter in the order of the power ratios 30/70 and 25/75 because the electric energy that was received by the upper electrode decreased, as mentioned above.

In the table of FIG. 11A, although when the low frequency insertion period was 0.4 in case where the electric power ratio was 40/60, the result was good electrodes as indicated as "○" in the figure. When the low frequency insertion period was 0.4 in case where the electric power ratio was 40/60, the result was no good electrodes. Comparing the case where the low frequency insertion period was 0.4 when the power ratios was 40/60, with the case where the low frequency insertion period was 0.4 when the power ratio was 45/55, electric energy that was sent out from the lower electrode, becomes small, so that the temperature of the lower electrode became low, whereby unnecessary projections formed. For this reason, in the case where the electric power ratio was 45/55, when the low frequency insertion period was set to 0.45, which was longer than 0.4 (which was the low frequency insertion period 45/55), a period, in which the lower electrode was heated, became longer so that it was possible to melt unnecessary projections. Moreover, in the table of FIG. 11A, although when the low frequency insertion period was selected appropriately in case where the electric power ratio was 25/75, the result was good electrodes as indicated as "○" in the figure. In the case where the electric power ratio was 20/80, all results were no good irrespective of the low frequency insertion period. Moreover, in case where the electric power ratio was 50/50, all results were no good irrespective of the low frequency insertion period. That is, the electric power ratio is desirably set to a range of 1/3≦[electric power ratio]<1.

The relation of the mentioned above power ratio and low frequency insertion period, which is indicated as a symbol "○", is shown in a graph of FIG. 11B. A symbol X represents a power ratio x (wherein x=[electric energy, which is sent out from an upper electrode to a lower electrode]/[electric energy, which is sent out from the lower electrode to the upper electrode]) (abscissa axis corresponds to the above-mentioned the power ratio E (=D), and a y axis (vertical axis) represents a low frequency insertion period at that time). In the graph, four line segments are drawn, each of which indicates criticality in cases where low frequency insertion periods were good as shown by a symbol "○" in the table of FIG. 11A. The critical values read from the table of FIG. 11A are shown in FIG. 11C. In addition, values of the table in FIG. 11C are plotted in a graph of FIG. 11B. At the first row of the table shown in FIG. 11C, [25/75], [30/70] . . . , and [45/55] indicate "Duty" in the table shown in FIG. 11A, and at the second row, 0.33, 0.44 . . . 0.82 indicate the above-mentioned power ratios, which are respectively represented as decimal points. Moreover, each value of the rows under the second row is a critical value read from the table of FIG. 11A. For example, the values, 0.55 and 1.4 in the row [25/75] of the table of FIG. 11A indicate critical values of the predetermined low frequency insertion frequency where values of the Duty in the table shown in FIG. 11A are indicated as "○". The values, 0.45 and 1.5 in the row [30/70] of the table of FIG. 11A indicate critical values of the low frequency insertion frequency where values of the Duty in the table shown in FIG. 11A are indicated as "○". Moreover, values 2.0 and 0.32, of the column [25/75], and values 1.7 and 0.35, of the column of [30/70] indicate the points, at which lines formed by extending the critical values of the low insertion frequency, which are indicated as "○", cross the column of Duty [25, 75] and [30/70], respectively in FIG. 11A.

Among the four lines shown in the graph of FIG. 11B, a formula "y=−0.01x+0.8" indicates critical values of "B: Upper: Low" in the table of FIG. 11A, and a formula "y=0.006x+0.15" indicates critical value of "C: Lower: Low" in the table of FIG. 11A. Moreover, a formula "y=−0.04x+3" indicates critical values of "E: Upper: high", and a formula y=0.03x+0.8 indicates critical values of "F: Lower: High" in the table of FIG. 11A. Therefore, if, depending on electric power "x", the low frequency insertion period "y" is set to be within a range of the two formulae (a) and (b), which are set forth below, in the case of vertical arrangement, it is possible to suppress loss/damage to and suppress formation of unnecessary projections on the upper and lower electrodes.

$$-0.01x+0.8 \leqq y \leqq 0.03x+0.8 \quad \text{(a)}$$

$$0.006x+0.15 \leqq y \leqq -0.04x+3 \quad \text{(b)}$$

Experimental Result 2

An experiment, in which a lamp was lighted by the method B, was conducted to examine a range of a period of a low frequency (or degree of repetition) in the case of vertical arrangement, which was more desirable than a period of a low frequency (or degree of repetition) in the case of horizontal arrangement. The maximum outer diameter of a silica glass discharge tube of the lamp used for the experiment was ϕ11.3 mm. In a light emission section, mercury of 0.29 mg/mm$^3$, bromine gas of $3\times10^{-3}$ μmol/mm$^3$, and rare gas of 100 Torr were enclosed, and a distance between electrodes was 1.1 mm. In the case of vertical arrangement, the lamp was lighted for two hundred hours, under lamp lighting conditions where steady lighting frequency was set to 370 Hz, and the low frequency was set to 46 Hz. At this time, in the method B, a power ratio at steady frequency in the case of vertical arrangement (a ratio of electric power that was sent from an electrode arranged in an upper side to an electrode arranged in a lower side to electric power that was sent from the electrode arranged in the lower side to the electrode arranged in the upper side), was set to 50/50 (equivalent to the above-mentioned power ratio C). On the other hand, the lamp was lighted at a low frequency power ratio of 20/80, 25/75, 30/70, 35/65, 40/60, 45/55, and 50/50, respectively, wherein the low frequency insertion period (degree of repetition or frequency thereof) was changed in each electric power ratio.

As mentioned above, in the case of horizontal arrangement, the low frequency insertion time (degree of repetition thereof) was set so that the low frequency was inserted for 1,000 seconds every 100 minute lighting at steady lighting frequency, and this was set as a reference. In case where the low frequency was inserted for 1,000 seconds every time lighting was performed for 100 minutes at steady lighting frequency in the case of vertical arrangement, the insertion period was indicated as "1" with respect to the above-mentioned reference. When (a period of) the low frequency, which was ten percent longer than the reference, that is, 1,100 sec, was inserted every time lighting was performed for 100 minutes lighting at steady lighting frequency, the insertion period was indicated as "1.1". In such a situation, the lamp was lighted according to various insertion periods (degree of repetition thereof). The electrodes were observed after the lamp was lighted for two hundred hours according to those low frequency insertion periods (degree of repetition or frequency thereof), and a symbol "○" was given to cases where a tip shape thereof does not have unusual consumption or deformation (where 70 percent or more of the life time of the electrodes in the case of horizontal lighting could be secured), and "NG" was given to cases where the tip shape thereof has unusual consumption or deformation (less than 70 percent of the life time thereof).

Figures 12A, 12B, 12C:
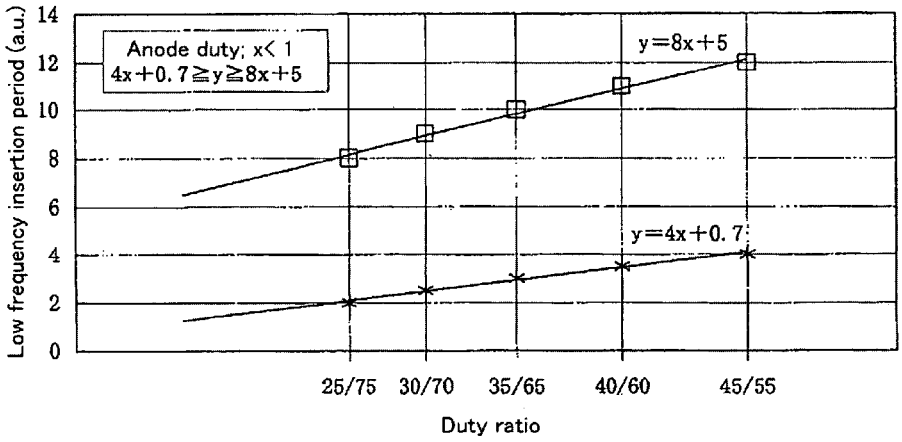
FIGS. 12A, 12B, and 12C are diagrams showing an experimental result (2)
Figure 13A:
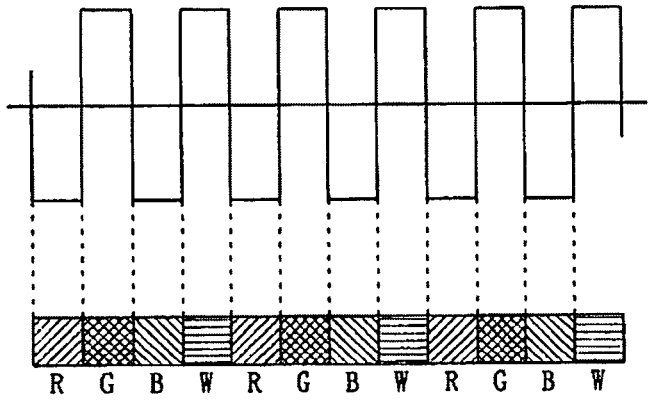
FIG.13A PRIOR ART
FIGS. 13A and 13B are diagrams showing a current waveform, the color wheel, and area change timing of a light source apparatus of prior art.
Figure 13B:
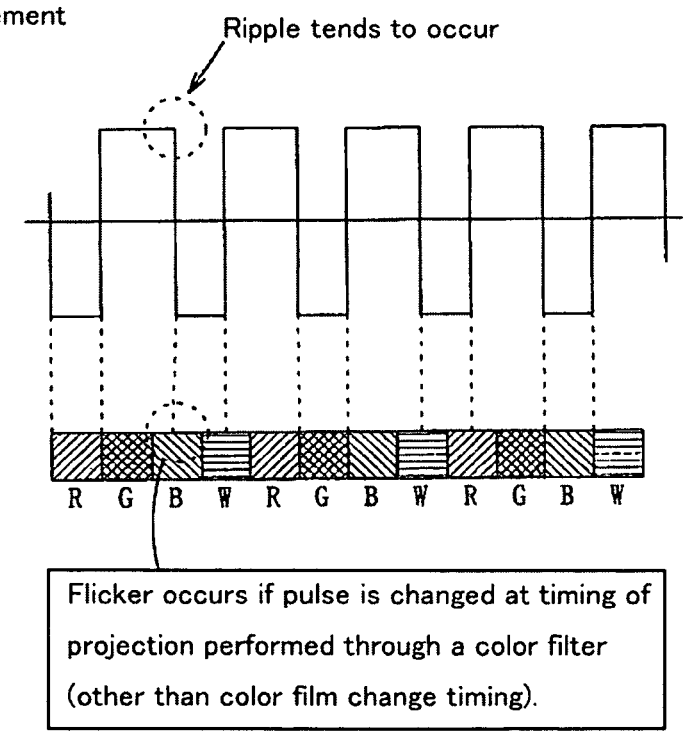
FIG.13B PRIOR ART

FIGS. 12A, 12B, and 12C show a summarized experimental result. In a case where a lamp was lighted according to the method B, since only the power ratio of low frequency is controlled, the criticality is shown by two line segments. FIG. 12A is a table showing the quality of the electrodes in case where the predetermined low frequency insertion period (which is referred to as "Low frequency insertion frequency" in FIG. 12A) was changed in each electric power ratio (which is referred to as "Duty ratio" in FIG. 12), and the positions of the no good electrodes and causes thereof where the electrodes were considered as no good, were filled in. The electric power ratio (Duty) was changed in a range from 20/80 to 50/50, and the shapes of the electrodes in each low frequency insertion period were observed. Here, "E: Upper: High" shows a case where the upper electrode is no good, and the temperature of the upper electrode became high, whereby the projection(s) melted, and "F: Lower: High" shows a case where the lower electrode was no good and the temperature of the lower electrode became high, whereby the projection(s) thereon melted. Moreover, in the table of FIG. 12A, although the result was good electrodes as indicated as "○" in the figure, when the low frequency insertion period was selected appropriately in case where the electric power ratio was 20/75, all results were no good in case where the electric power ratio was 20/80, regardless of the low frequency insertion period. Moreover, in case where the electric power ratio was 50/50, all results were no good regardless of the low frequency insertion period. That is, the electric power ratio is desirably set to within a range of $1/3 \leqq$[electric power ratio]$<1$.

A graph in FIG. 12B shows the relation of the power ratio and the low frequency insertion period in the case of the symbol "○", wherein the symbol "X" represents [power ratio at low frequency in the case of horizontal lighting]=[electric energy, which was sent from an upper electrode to a lower electrode]/[electric energy, which was sent from the lower electrode to the upper electrode] (abscissa axis x, which corresponds to the above-mentioned power ratio E, and "y" (axis of ordinate) represents the low frequency insertion period at this time). In the graph, there are two line segments, which indicates criticality in case where a low frequency insertion period is indicated as the symbol "○", respectively in the table of FIG. 12A. Similarly to the table of FIG. 11C, the critical values read from the table of FIG. 12A are shown in FIG. 12C, and the values of the table in FIG. 12C are plotted in the graph of FIG. 12B. In the graph shown in FIG. 12B, the formula $y=8x+5$ indicates critical values of "F: Lower: High" in FIG. 12A, and the formula $y=4x+0.7$ indicates critical values of "E: Upper: High"] in FIG. 12A. Therefore, if, depending on the power ratio x, the low frequency insertion period "y" is set to fall within the range of the formula:

$$4x+0.7 \leqq z \leqq 8x+5 \quad \text{(c)},$$

in the case of vertical arrangement, it is possible to suppress damages to the upper and lower electrodes and an unnecessary projection(s) can be suppressed from being formed.

The preceding description has been presented only to illustrate and describe exemplary embodiments of the present light source apparatus. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A light source apparatus comprising:

a discharge lamp that encloses mercury and comprises a pair of electrodes arranged to face each other; and a power supply apparatus that supplies a first alternating current at a first predetermined frequency to the discharge lamp, the power supply apparatus inserts a second alternating current at a second predetermined frequency which is lower than the first predetermined frequency, and the power supply apparatus supplies the second alternating current to the discharge lamp, wherein, when the discharge lamp is placed horizontally, a first electric energy ratio A/B of the first alternating current is set to a first value C, and a second electric energy ratio A/B of the second alternating current is set to the first value C, when the discharge lamp is placed vertically, a first electric energy ratio A'/B' of the first alternating current is set to the first value C, and a second electric energy ratio A'/B' of the second alternating current is set to a third value E, the third value E being smaller than the first value C, and wherein the value A' represents an electric energy that flows from one of the electrodes arranged in a lamp upper side to another one of the electrodes arranged in a lamp lower side of the pair of electrodes and the value B' represents an electric energy that flows from the electrode arranged in the lower side to the electrode arranged in the upper side, wherein the power supply apparatus inserts the second alternating current into the first alternating current according to a predetermined insertion frequency.

2. The light source apparatus according to claim 1, wherein the first value C is about 1 and the third value E is about ⅓.

3. The light source apparatus according to claim 1, further comprising:

a detecting circuit configured to detect the discharge lamp being in a horizontal arrangement or in a vertical arrangement.

4. The discharge lamp according to claim 1, wherein a power supply apparatus is configured to supply a first alternating current at a first predetermined frequency to the discharge lamp, the power supply apparatus inserts a second alternating current at a second predetermined frequency which is lower than the first predetermined frequency, and the power supply apparatus is configured to supply the second alternating current to the discharge lamp.

5. The discharge lamp according to claim 4, wherein, when the discharge lamp is placed horizontally, a first electric energy ratio A/B of the first alternating current is set to a first value C, and a second electric energy ratio A/B of the second alternating current is set to the first value C.

6. The discharge lamp according to claim 5, wherein, when the discharge lamp is placed vertically, a first electric energy ratio A'/B' of the first alternating current is set to the first value C, and a second electric energy ratio A'/B' of the second alternating current is set to a third value E, the third value E being smaller than the first value C.

7. The discharge lamp according to claim 6, wherein the value A' represents an electric energy that flows from one of the electrodes arranged in a lamp upper side to another one of the electrodes arranged in a lamp lower side of the pair of electrodes and the value B' represents an electric energy that flows from the electrode arranged in the lower side to the electrode arranged in the upper side.

8. The discharge lamp according to claim 4, wherein a detecting circuit is configured to detect the discharge lamp being in a horizontal arrangement or in a vertical arrangement.

9. The discharge lamp according to claim 1, wherein the power supply apparatus inserts the second alternating current into the first alternating current according to a predetermined insertion frequency.

10. The discharge lamp according to claim 4, wherein the first value C is about 1 and the third value E is about ⅓.

11. A light source apparatus comprising:

a discharge lamp that encloses mercury and comprises a pair of electrodes arranged to face each other; and a power supply apparatus that supplies a first alternating current at a first predetermined frequency to the discharge lamp, the power supply apparatus inserts a second alternating current at a second predetermined frequency which is lower than the first predetermined frequency. and the power supply apparatus supplies the second alternating current to the discharge lamp, wherein, when the discharge lamp is placed horizontally, a first electric energy ratio A/B of the first alternating current is set to a first value C, and a second electric energy ratio A/B of the second alternating current is set to the first value C, when the discharge lamp is placed vertically, a first electric energy ratio A'/B' of the first alternating current is set to the first value C, and a second electric energy ratio A'/B' of the second alternating current is set to a third value E, the third value E being smaller than the first value C, and wherein the value A' represents an electric energy that flows from one of the electrodes arranged in a lamp upper side to another one of the electrodes arranged in a lamp lower side of the pair of electrodes and the value B' represents an electric energy that flows from the electrode arranged in the lower side to the electrode arranged in the upper side, wherein the power supply apparatus inserts the second alternating current into the first alternating current according to a predetermined insertion frequency, wherein the second electric energy ratio A'/B' is set to the third value E, wherein the third value E is set to fall within a range of $\frac{1}{3} \leqq E < 1$, and the insertion frequency z×100% is set to fall within a formula:

$$4E+0.7 \leqq z \leqq 8E+5.$$

* * * * *